US008689881B2

(12) United States Patent
Nadarajah et al.

(10) Patent No.: US 8,689,881 B2
(45) Date of Patent: Apr. 8, 2014

(54) OFFSHORE UNIT AND METHOD OF INSTALLING WELLHEAD PLATFORM USING THE OFFSHORE UNIT

(71) Applicant: Kingtime International Limited, Singapore (SG)

(72) Inventors: Nagendran C. Nadarajah, Kuala Lampur (MY); Renata Anita De Raj, Kuala Lampur (MY); Mahendran Sippiah, Kuala Lumpur (MY)

(73) Assignee: Kingtime International Limited, Singapore (SG)

( * ) Notice: Subject to any disclaimer, the term of this patent is extended or adjusted under 35 U.S.C. 154(b) by 0 days.

(21) Appl. No.: 13/782,007

(22) Filed: Mar. 1, 2013

(65) Prior Publication Data

US 2013/0177358 A1 Jul. 11, 2013

Related U.S. Application Data

(63) Continuation of application No. 12/943,412, filed on Nov. 10, 2010, now Pat. No. 8,403,058, which is a continuation of application No. PCT/MY2009/000038, filed on Mar. 19, 2009.

(30) Foreign Application Priority Data

May 14, 2008 (WO) ..... PCT/MY2008/000043

(51) Int. Cl.
*E21B 19/00* (2006.01)

(52) U.S. Cl.
USPC ..... 166/365; 166/339; 166/344; 166/352; 166/378; 405/196; 405/203; 405/205

(58) Field of Classification Search
USPC ..... 166/365, 339, 341, 344, 351–354, 378, 166/379; 405/196–200, 203, 205, 207, 210, 405/224; 114/264–266
See application file for complete search history.

(56) References Cited

U.S. PATENT DOCUMENTS 3,837,309 A * 9/1974 Biewer ..... 114/265
3,996,754 A * 12/1976 Lowery ..... 405/197

(Continued)

FOREIGN PATENT DOCUMENTS

GB 2080860 A * 2/1982 ..... E02B 17/02
GB 2 292 406 2/1996

(Continued)

OTHER PUBLICATIONS

International Search Report and Written Opinion for International Application No. PCT/MY2009/000038, mailed May 12, 2010.

(Continued)

*Primary Examiner* — Matthew Buck
(74) *Attorney, Agent, or Firm* — McCarter & English, LLP

(57) ABSTRACT

An offshore unit includes a hull and/or a deck frame, a mat attached to at least one connecting leg or a spud can attached to each of at least one connecting leg or lower hull attached to at least one connecting means. A wellhead deck is removably attached to the hull and/or deck frame and a sub-sea clamp in conjunction with a caisson or a sub-sea conductor frame is removably attached to the mat or to the at least one connecting leg, where a spud can is attached to each of the at least one connecting leg, or to the lower hull. The offshore unit is relocatable and is a platform or a rig capable of performing drilling, production, construction, accommodation, hook-up and commissioning or a combination of any of these functions thereof. The offshore unit is a self-elevating mobile platform or submersible platform or semi-submersible platform.

21 Claims, 21 Drawing Sheets

(56) References Cited

U.S. PATENT DOCUMENTS

| | | | | | |
|---|---|---|---|---|---|
| 4,266,887 | A * | 5/1981 | Corder | 405/196 |
| 4,493,591 | A * | 1/1985 | Francis, Jr. | 405/198 |
| 4,658,903 | A * | 4/1987 | Tateishi | 166/335 |
| 4,685,409 | A * | 8/1987 | Liden | 114/74 R |
| 4,716,972 | A * | 1/1988 | Makinen et al. | 175/8 |
| 4,854,778 | A * | 8/1989 | Valenzuela | 405/204 |
| 4,907,912 | A * | 3/1990 | Smith | 405/208 |
| 5,188,484 | A * | 2/1993 | White | 405/198 |
| 5,190,410 | A * | 3/1993 | Nunley | 405/196 |
| 6,164,234 | A * | 12/2000 | Manschot et al. | 114/265 |
| 6,196,767 | B1 * | 3/2001 | Thomas | 405/203 |
| 6,374,764 | B1 * | 4/2002 | Davenport et al. | 114/265 |
| 6,409,431 | B1 * | 6/2002 | Lynch | 405/200 |
| 6,539,888 | B1 * | 4/2003 | van der Poel | 114/265 |
| 6,652,192 | B1 * | 11/2003 | Xu et al. | 405/195.1 |
| 6,869,252 | B1 * | 3/2005 | Maini et al. | 405/224 |
| 7,156,040 | B2 * | 1/2007 | Merchant et al. | 114/293 |
| 7,219,615 | B2 * | 5/2007 | Merchant et al. | 114/265 |
| 7,451,821 | B2 * | 11/2008 | Rashid et al. | 166/358 |
| 7,850,398 | B2 * | 12/2010 | Foo et al. | 405/212 |
| 8,403,058 | B2 * | 3/2013 | Nadarajah et al. | 166/365 |
| 2006/0051164 | A1 * | 3/2006 | Foo et al. | 405/228 |

FOREIGN PATENT DOCUMENTS

| | | | | |
|---|---|---|---|---|
| GB | 2323620 | A * | 9/1998 | E02B 17/02 |
| NL | 135 005 | C | 9/1972 | |

OTHER PUBLICATIONS

Written Opinion for International Application No. PCT/MY2009/000038, mailed Nov. 14, 2010.

* cited by examiner

OFFSHORE UNIT AND METHOD OF INSTALLING WELLHEAD PLATFORM USING THE OFFSHORE UNIT

CROSS-REFERENCE TO RELATED APPLICATIONS

This application is a division of U.S. patent application Ser. No. 12/943,412, filed Nov. 10, 2010, now U.S. Pat. No. 8,403,058, which is a continuation of International Patent Application PCT/MY2009/00038, filed Mar. 19, 2009, and claims priority under 35 U.S.C. §119(a)-(d) to International Patent Application PCT/MY2008/00043, filed May 14, 2008. The contents of these references are incorporated by reference herein.

FIELD OF INVENTION

The present invention relates a method of installing wellhead platform using an offshore unit.

BACKGROUND OF THE INVENTION

The high energy demand in the world has subjected oil prices to wild swings but the demand for oil continues unabated. It is also clear from recent reports that the energy industry has to continue increasing the supply of hydrocarbon fuels to meet the global energy demand. However, an offshore hydrocarbon field will only be exploited if the field can produce enough net income to make it worth developing at a given time; dependent upon a combination of technical, commercial, regulatory, production sharing terms and also an oil & gas company's own Internal Rate of Return. Most of the fields that have been developed to date have been based on the "satellite principle," which means that existing pipeline transportation infrastructure and production facilities in the vicinity of the identified field are used so that the development costs are significantly reduced. The remaining unexploited fields are often located in remote locations with little or no infrastructure and of a size or nature that often make it impossible to predict with certainty the amount or composition of recoverable hydrocarbon in place. These fields are often referred to as small, marginal, unconventional reservoirs or stranded assets.

The wild swings in oil prices however brings with it new challenges. Development costs have been pushed to new highs. Competition for the same resources for, e.g., skilled manpower, specialized plant and equipment and space in fabrication yards have also resulted in resource constraints.

Consequently platforms have been over or under designed resulting in technicians, tools and equipment transported to site to carry out costly modifications.

Conventional offshore platforms are built from components that are transported separately from fabrication sites to offshore installation sites where they are put together utilizing barge mounted heavy lift cranes and/or jack-up drilling rig mounted derricks.

Due to the shortage of such crane barges and jack-up rigs, the mobilization or demobilization costs and day rates for these units have increased. Installation of platforms to extract hydrocarbons at small and marginal fields is no longer economically viable mainly due to this escalation in costs.

There is therefore an urgent requirement to considerably reduce the costs of these marginal field developments and consequently make these developments economically viable. Many concepts have already been developed and are being offered by the industry.

This led to the invention of self-installing platforms called mobile offshore production unit which can easily be re-locatable without the need for a derrick barge or a jack-up drilling rig. The mobile offshore production unit is used adjacent to a wellhead platform that supports drilling operation. Hydrocarbons extracted via the wellhead platform are sent to the mobile offshore production platform for separation and further conditioning before being returned to the wellhead platform for onward transportation to a pipeline network or a Floating Storage and Offloading (FSO) vessel.

The mobile offshore production unit can only be operational where a pre-installed wellhead platform with risers linked to a pipeline network or an FSO is present. For marginal fields and medium sized fields in remote locations where a pipeline network is non-existent, the high costs associated with the installation and de-installation of the wellhead platform and an FSO will not make the project economically viable.

Therefore, there is a need for the mobile offshore production unit to be made versatile for use at small and marginal fields with solutions to overcome uncertainty and high costs associated with the installation of wellhead platforms for drilling and FSO for storage.

Furthermore, these wellhead platforms are constructed based on assumptions on the likely outcomes of ultimate hydrocarbon recovery. These outcomes are based on seismic data and/or exploration wells drilled at the location. This method has often resulted in over design and sub optimized platforms resulting in unnecessary capital expenditure for the field owner/operator. It is widely acknowledged that economics of exploiting stranded assets are easily affected by changes in basic economic conditions such as capital expenditure, time to first oil, operating costs, production levels, recoverable reserves and abandonment costs which can have a major effect on the profitability of the venture. If a field is marginal because of the uncertainty over the level of reserves, a period of exploration often referred to as extended well test will give additional reservoir information and will reduce uncertainty thereby leading to improved decision making. There is therefore an urgent need for an operator or field owner to exploit these so called stranded assets in an incremental, optimal and cost effective manner.

Several methods have been developed for the installation of wellhead platforms without using crane barges and drilling rigs. One such method is the Suction-piled Stacked Frame (SSF) platform as described in the "Proceedings of the Eleventh (2001) International Offshore and Polar Engineering Conference," Stavanger, Norway, Jun. 17-22, 2001, a purpose designed satellite wellhead platform. The following is an extract from a paper presented during the conference:

> The attractiveness of the SSF platform is essentially based on its cost-effectiveness compared with existing marginal platform concepts, whereby the main cost differentiators are the efficient use of materials and the installation method. The SSF platform consists of three conductors that support a small deck, the export riser and a ladder arrangement for safe access from a boat. The base of the structure comprises a frame, which incorporates suction cans and conductor guides. The conductors are simultaneously used as jacket legs and they are positioned approximately 7 meters from each other. They are braced by three frames that are positioned at the appropriate elevation to give adequate structural strength. The frames are being fixed to the conductors by means of grouting.
>
> Apart from the drilling and jacket leg function, the conductors also form part of the foundation. However, depending on water depth and the environmental loading, the three conductors will in many cases not have sufficient bearing capacity on their own and hence additional suction cans are added to make up the SSF platform foundation. The main function of the suction cans is to carry the base shear, but they carry part of the vertical loads, caused by the overturning moment, as well. The suction cans are connected to the lowest stacked frame and they are positioned outside the footprint of the conductors. The upper stacked frame, apart from providing stability and stiffness to the structure, simultaneously serves as the topside deck.

The SSF and similar wellhead platform installation concepts are suitable for minimum facilities developments with limited number of wells (up to 6) and minimal topsides facilities (up to 150 MT) as stated in the above paper, allowing in most cases only primary recovery of hydrocarbons. More well slots are required for secondary recovery via water injection, gas lift, etc. to maximize recovery. Larger wellhead platforms offering the flexibility to add conductors and wells as the field develops have become a necessity.

Therefore there is a need for a method to install wellhead platform with required number of wells that eliminates steps of separately installing the wellhead platform using crane barges and/or jack-up drilling rigs resulting in an optimal configuration.

SUMMARY OF INVENTION

The present invention relates to an offshore unit which includes hull and/or deck frame, a mat attached to at least one connecting leg or a spud can attached to each of at least one connecting leg or lower hull attached to at least one connecting means, wherein the offshore unit further includes a wellhead deck which is removably attached to the hull and/or deck frame and a sub-sea clamp or a sub-sea conductor frame removably attached to the mat or to the at least one connecting leg, where a spud can is attached to each of the at least one connecting leg, or to the lower hull. The hull and/or deck frame and the mat or the spud can is connectable with the at least one connecting leg. Besides that, the hull and/or deck frame and the lower hull is connectable with the at least one connecting means.

The offshore unit is a platform or a rig that is relocatable and capable of performing drilling, production, construction, accommodation, hook-up and commissioning or a combination of any of these functions The offshore unit is a self-elevating mobile platform or submersible platform or semi-submersible platform. The self-elevating mobile platform is a platform that includes a hull and/or deck frame, a mat attached to at least one connecting leg and the at least one connecting leg substantially vertically upstanding from the mat to the hull and/or deck frame or a platform that includes a hull and/or deck frame, a spud can attached to each of at least one connecting leg and the at least one connecting leg substantially vertically upstanding from the spud can to the hull and/or deck frame.

The wellhead deck and the sub-sea clamp support a caisson to contain drilling casings. The caisson is pre-installed by clamping it to the mat attached to at least one connecting leg or to the at least one connecting leg, wherein a spud can is attached to each of the at least one connecting leg, or lower hull and securing it to the wellhead deck during tow of the platform. The wellhead deck and the sub-sea conductor frame support at least one conductor. The wellhead deck and the sub-sea conductor frame also support means for exploring hydrocarbon below sea bed.

The mat of the self-elevating mobile platform includes storage for storing crude oil, water, chemicals, air and/or other fluids, hereinafter referred to as fluids. The integral storage of fluids allows the self-elevating mobile platform to operate without a pipeline network or floating storage and offloading vessel. The mat is compartmentalized to provide redundancy in case of damage to a compartment or to store different types or grades of fluids. The at least one connecting leg also act as conduits as they contain piping to transport the fluids between the mat and the topsides facilities, eliminating the need for sub-sea connections that pose health, safety and environmental risks from potential leaks. Hydrocarbon fluids are then offloaded directly from the mat through the piping in the connecting leg via floating hoses and mooring hawser deployed from the hull to shuttle tankers.

The present invention also relates to a method of installing a wellhead platform which includes a wellhead deck, sub sea conductor frame and at least one conductor using an offshore unit wherein the method includes the steps of transporting the offshore unit to installation site, installing the offshore unit, installing at least one conductor through the wellhead deck and sub-sea conductor frame until the at least one conductor penetrate through soil layers to target penetration and securing the wellhead deck to the at least one conductor. The wellhead deck is removably attached to the hull and/or deck frame and the sub-sea conductor frame is removably attached to the mat or to the at least one connecting leg, wherein a spud can is attached to each of at least one connecting leg, or to the lower hull. The wellhead deck and sub-sea conductor frame are attached to the offshore unit while loading out and transporting the offshore unit from fabrication site to offshore installation site. The hull and/or deck frame and the mat or the spud can are connectable with the at least one connecting leg. Besides that, the hull and/or deck frame and the lower hull is connectable with the at least one connecting means.

The wellhead deck accommodates wellheads, manifolds, headers, launchers, receivers and other utilities to collect the hydrocarbons from wells and feed them into production facilities and to increase hydrocarbon flow rates. The wellheads are mounted on conductors containing drilling casings. The sub-sea conductor frame guides conductor installation and also provides support for the conductors.

The installing of the wellhead platform commences with an optional step of stacking up at least one means for supporting at least one conductor underneath the wellhead deck or on top of the sub-sea conductor frame. The at least one means for supporting at least one conductor is either being stacked-up underneath the wellhead deck or on top of the sub-sea conductor frame prior to the transporting of the offshore unit to the offshore installation site or the at least one means for supporting at least one conductor is being transported to the offshore installation site by transportation means. The at least one means for supporting at least one conductor from the transportation means is hoisted up and stacked-up underneath the wellhead deck or lowered down on top of the sub-sea conductor frame by using elevating means mounted on the offshore unit or the wellhead deck. The at least one means for supporting at least one conductor from underneath wellhead deck is lowered down along the at least one conductor to a predetermined level or elevated from above the sub-sea conductor frame to a predetermined level. The at least one means for supporting at least one conductor is lowered down by using lowering means or elevated using elevating means configured to predetermined lengths.

The installing of the self-elevating mobile platform includes lowering the mat or the spud can attached to each of the at least one connecting leg to sea bed and elevating the hull and/or deck frame to a predetermined height. As for the submersible platform, the installing of the platform includes the steps of ballasting the hull and/or lower hull until the lower hull reaches sea bed and predetermined soil bearing resistance is achieved. For the semi-submersible platform, the installing of the platform includes the steps of securing the platform to sea bed and lowering the sub-sea conductor frame to the seabed.

The present invention also relates to a method of installing a wellhead platform which includes a wellhead deck, a caisson and at least one securing means which holds the caisson using offshore unit which includes a hull and/or a deck frame, a mat attached to at least one connecting leg or a spud can attached to each of at least one connecting leg or lower hull attached to at least one connecting means, wherein the method includes the steps of transporting the offshore unit to installation site, installing the offshore unit, releasing the at least one securing means holding the caisson which allows the at least one caisson to penetrate through soil layers and securing the wellhead deck to the caisson. The wellhead deck is removably attached to the hull or deck frame. The caisson is installed on to the offshore unit prior to transporting of the offshore unit to the installation site. Alternatively, the caisson is transported to the installation site separately and installed onto the offshore unit using ballasting and hoisting means mounted on the offshore unit or the wellhead deck. The at least one caisson is clamped at the mat or the at least one connecting leg that is connected to one spud can or the lower hull and secured at the wellhead deck during the transporting of the offshore unit to installation site.

The present invention also relates to a method of demobilizing a self-elevating mobile platform which has been used to install the wellhead platform wherein the self-elevating mobile platform includes a hull and/or deck frame, a mat attached to at least one connecting leg or a spud can attached to each of at least one connecting leg, wherein the method includes the steps of hooking-up a pre-laid mooring system to the mat attached to the at least one connecting leg or to the at least one connecting leg where a spud can is attached to each of the at least one connecting leg and to the hull or to a transportation means where the deck frame is used without a hull, activating lowering means to lower the hull down to water level or the deck frame down onto the transportation means where the deck frame is used without a hull, activating heightening means to jack up the mat attached to the at least one connecting leg or the spud can attached to each of at least one connecting leg off sea bed, activating of maneuvering means to space apart the self-elevating mobile platform from the wellhead platform, activating heightening means to jack up the mat attached to the at least one connecting leg or the spud can attached to each of the at least one connecting leg until contact with the hull and/or deck frame, de-ballasting the mat attached to at least one connecting leg or hull where hull is used without a mat or transportation means where deck frame is used without a hull or mat to achieve tow conditions and disconnecting the mooring system from the mat attached to at least one connecting leg or the at least one connecting leg where a spud can is attached to each of the at least one connecting leg and from the hull or transportation means where the deck frame is used without a hull.

The mooring system which includes at least four sets of bridles is pre-laid prior to hooking-up to the self-elevating mobile platform. The at least four sets of bridles are made up of chains, tri-plates, shackles and/or wire ropes. Each of the at least four bridles are attached to securing means to seabed. The activating of maneuvering means to space apart the self-elevating mobile platform from the wellhead platform allows detachment of the wellhead platform from the self-elevating mobile platform. The detached wellhead platform is left behind for further drilling, well intervention, production and/or abandonment.

The method of installing a wellhead platform for exploring hydrocarbon below sea bed which includes a wellhead deck and sub-sea conductor frame using an offshore unit which includes a hull and/or a deck frame, a mat attached to at least one connecting leg or a spud can attached to each of at least one connecting leg or a lower hull, wherein the method includes the steps of transporting the offshore unit to offshore installation site, installing the offshore unit, deploying a means for exploring hydrocarbon below sea bed supported by the wellhead deck until the means for exploring hydrocarbon below sea bed penetrate through soil layers to target penetration, retrieving the means for exploring hydrocarbon, installing at least one at least one conductor through the wellhead deck and sub-sea conductor frame until the at least one conductor penetrate through soil layers to target penetration and securing the wellhead deck to the at least one conductor. The wellhead deck is removably attached to the hull and/or deck frame and wherein the sub-sea conductor frame is removably attached to the mat or to the at least one connecting leg, wherein a spud can is attached to each of at least one connecting leg, or to the lower hull.

The wellhead deck and sub sea conductor frame are attached to the offshore unit prior to loading out and transporting the platform from fabrication site to the offshore installation site. The hull and/or deck frame and the mat or the spud can are connectable with the at least one connecting leg. The hull and/or deck frame and the lower hull is connectable with the at least one connecting means. The steps of installing at least one conductor through the wellhead deck and sub-sea conductor frame until the at least one conductor penetrate through soil layers to target penetration and securing the wellhead deck to the at least one conductor are not required when cost of production is expected to be higher than cost of recoverable reserves in which case the offshore unit will be demobilized.

BRIEF DESCRIPTION OF THE DRAWINGS

The present invention will be fully understood from the detailed description given herein below and the accompanying drawings which are given by way of illustration only, and thus are not limitative of the present invention, wherein.

DETAILED DESCRIPTION OF EMBODIMENTS OF THE INVENTION

Figure 1:
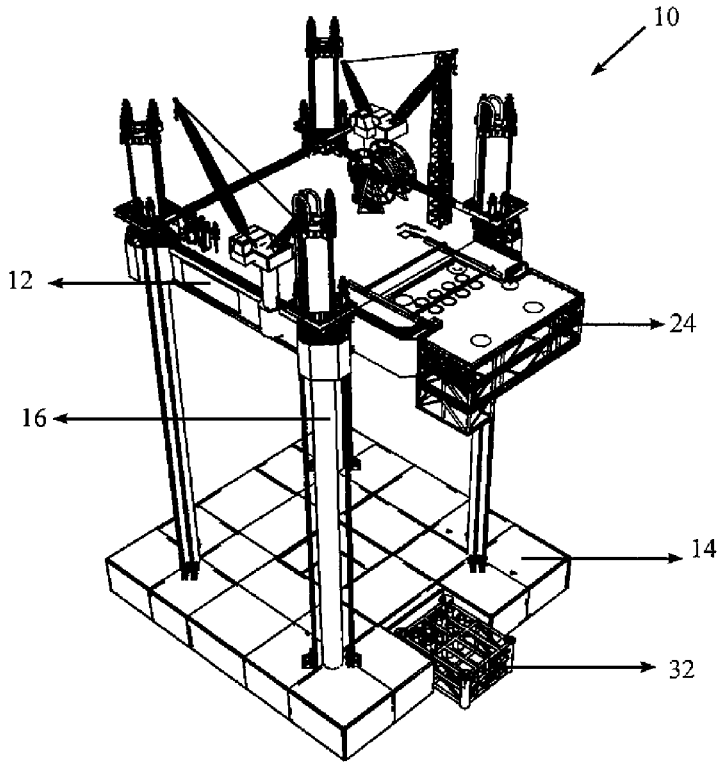
FIG. 1 is a diagrammatic view illustrating the wellhead platform components, wherein the wellhead deck and sub-sea conductor frame, attached to self-elevating mobile platform in its as-installed position.

The present invention relates to an offshore installation methodology of a wellhead platform (22) capable of accommodating any number of wells, by an offshore unit (10, 58, 60, 62, 64, 70), the number of wells limited only by the size of the offshore unit (10, 58, 60, 62, 64,70) and the platform cranes thereon, and demobilization methodology of the offshore unit (10, 58, 60, 62, 64, 70). Besides that, the present invention also relates to a method of installing a wellhead platform (22) for exploring hydrocarbons below sea bed using the offshore unit. The present invention also relates to different variants of the offshore unit, wherein a drilling template is attached to the offshore unit, and the offshore with the drilling template is used for installing the wellhead platform (22). A detailed description of preferred embodiments of the invention is disclosed herein. It should be understood, however, that the disclosed preferred embodiments are merely exemplary of the invention, which may be embodied in various forms. Therefore, the details disclosed herein are not to be interpreted as limiting, but merely as the basis for the claims and for teaching one skilled in the art of the invention.

More particularly, the invention relates to the installation of a wellhead platform (22) by the offshore unit (10, 58, 60, 62, 64, 70), without the use of heavy lift crane barges and/or jack-up drilling rigs. The wellhead platform is installed to enable drilling for hydrocarbons and completion with wellheads above sea water level. Wellhead platforms are conventionally installed by transporting various components separately on barges from fabrication sites to offshore installation sites and installing using heavy lift crane barges and/or jack-up drilling rigs.

The present invention now describes an offshore unit, wherein a drilling template is attached to the offshore unit and used for installing the wellhead platform. The offshore unit is a platform or a rig capable of performing drilling, production, construction, accommodation, hook-up and commissioning or a combination of any of these functions. The offshore unit is relocatable or fixed. The relocatable offshore unit can be a self-elevating mobile platform (10, 60, 62, 64) or submersible platform (70) or semi-submersible platform (58).

The self-elevating mobile platform (10, 60, 62, 64) can be any one of the following platforms:

a platform (10) that includes a hull (12), a mat (14) and at least one connecting leg (16) substantially vertically upstanding from the mat (14) to the hull (12);

a platform (64) that includes a deck frame (52), a mat (14) and at least one connecting leg (16) substantially vertically upstanding from the mat (14) to the deck frame (52);

a platform (62) that includes a hull (12), a spud can (50) attached to each of at least one connecting leg (16) substantially vertically upstanding from the spud can (50) to the hull (12);

a platform (60) that includes a deck frame (52), a spud can (50) attached to each of at least one connecting leg (16) substantially vertically upstanding from the spud can (50) to the deck frame (52).

Besides the above mentioned platforms, the self-elevating mobile platform comes in combination of hull (12) and deck frame (52) for the platforms mentioned in (i) and (iii). The deck frame (52) is on the hull (12) and wellhead deck (24) attached to the hull and/or deck frame (52).

As for the submersible (70) and semi-submersible platforms (58), the platform includes a hull (12) and/or a deck frame (52), a lower hull (18) and at least one connecting means (66) substantially vertically upstanding from the lower hull (18) to the hull (12) and/or deck frame (52).

A drilling template which can be removably attached to be a stand-alone wellhead platform (22) has been added to the offshore unit. The self installing drilling template is attached to the offshore unit (10, 58, 60, 62, 64, 70) at onshore site and towed to offshore installation site as a single unit. The drilling template includes a wellhead deck which is removably attached to the hull and/or deck frame, and a sub-sea clamp in conjunction with a caisson or a sub-sea conductor frame removably attached to the mat or to the at least one connecting leg, where a spud can is attached to each of the at least one connecting leg, or to the lower hull. Further to define the drilling template, it is arranged in two configurations.

One configuration includes a wellhead deck (24) removably attached to the hull (12) and/or deck frame (52) of the offshore unit and sub-sea conductor frame (32) removably attached to the mat (14) attached to at least one connecting leg (16) or to the at least one connecting leg (16), wherein a spud can is attached to each of at least one connecting leg (16) or to the lower hull (18) of the offshore unit. This configuration is used to supports at least one conductor (26).

The second configuration includes wellhead deck (24) removably attached to the hull (12) and/or deck frame (52) of the offshore unit, caisson and caisson sub-sea clamp (20) attached to the mat (14) attached to at least one connecting leg (16) or to the at least one connecting leg (16), wherein a spud can is attached to each of at least one connecting leg (16) or to the lower hull (18) of the offshore unit. The second configuration is used to hold a caisson (28) to contain drilling casings.

Figure 2:
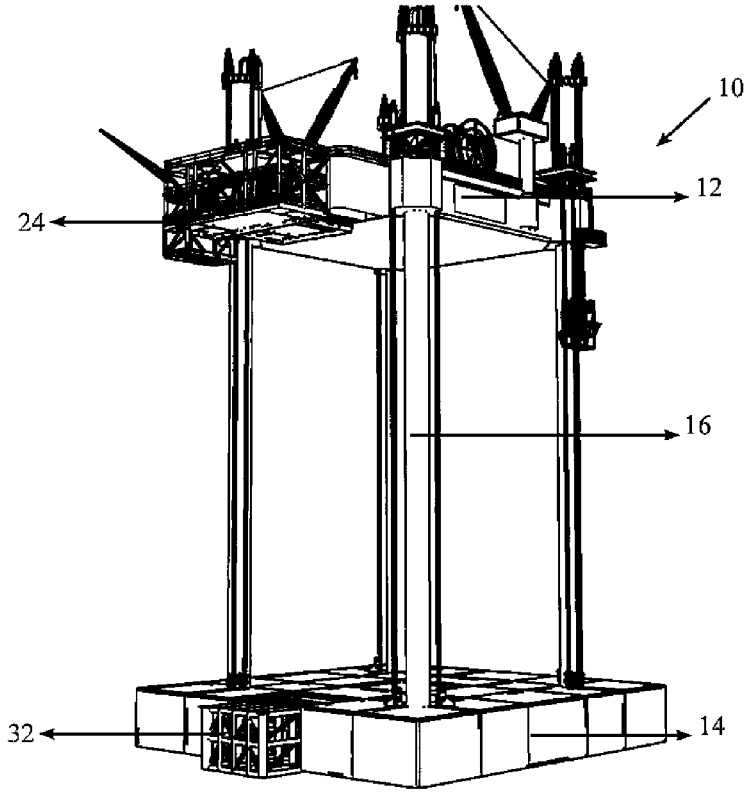
FIG. 2 is diagrammatic view of the wellhead platform components taken from underneath the wellhead deck.
Figure 3:
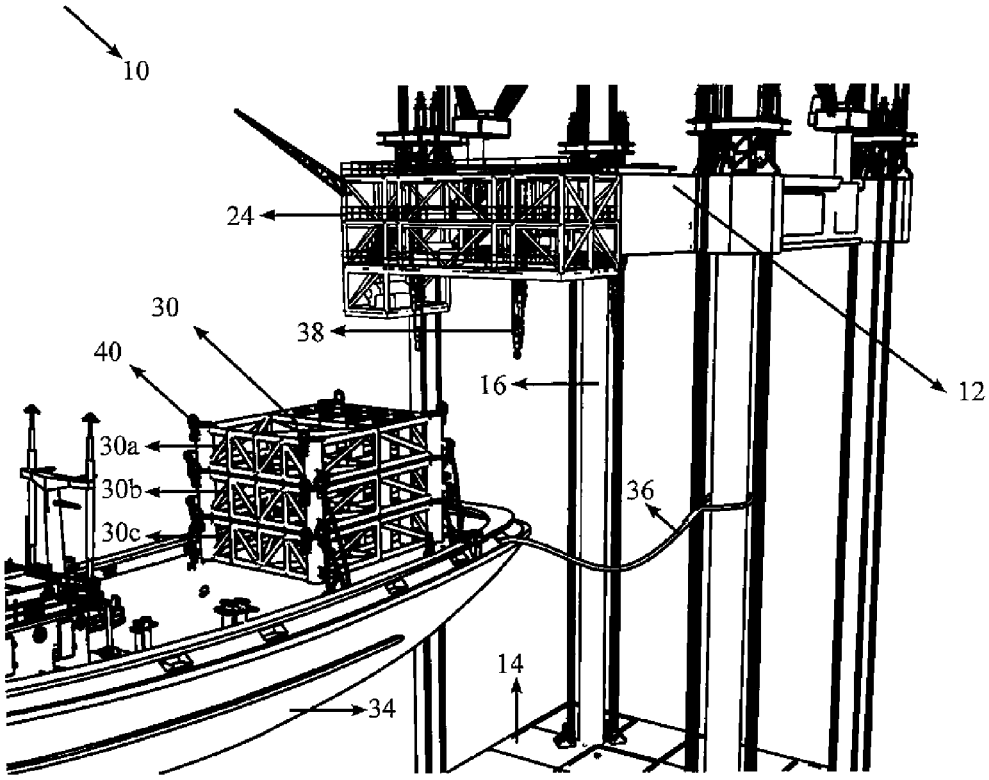
FIG. 3 shows a diagrammatic view of the workboat, with wellhead platform mid-span conductor frames rigged-up and stacked-up, being positioned under the wellhead deck.
Figure 4:
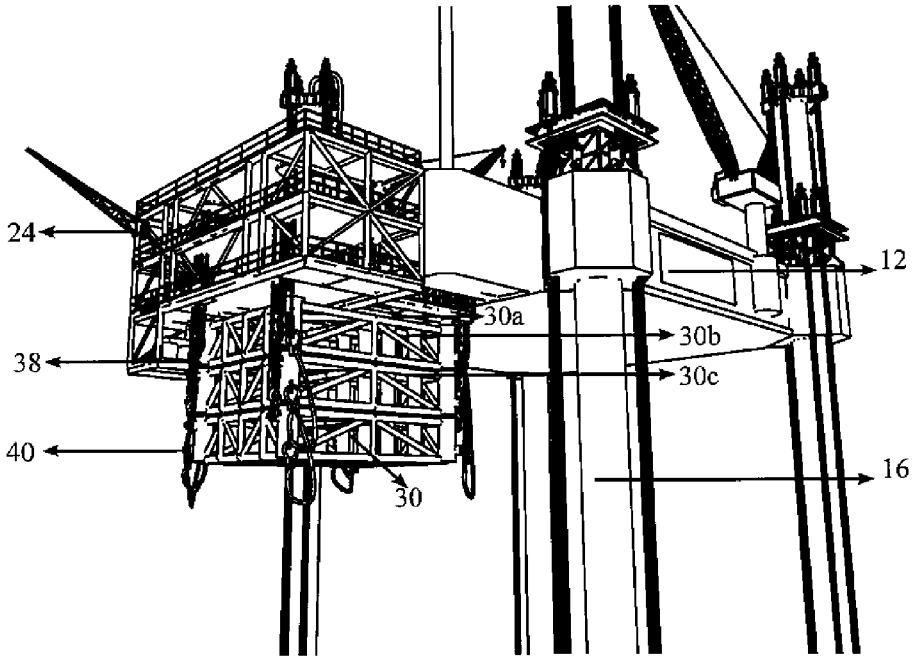
FIG. 4 shows a diagrammatic view of the mid-span conductor frames hooked-up to winches/chain-blocks and stacked-up underneath the wellhead deck.
Figure 5:
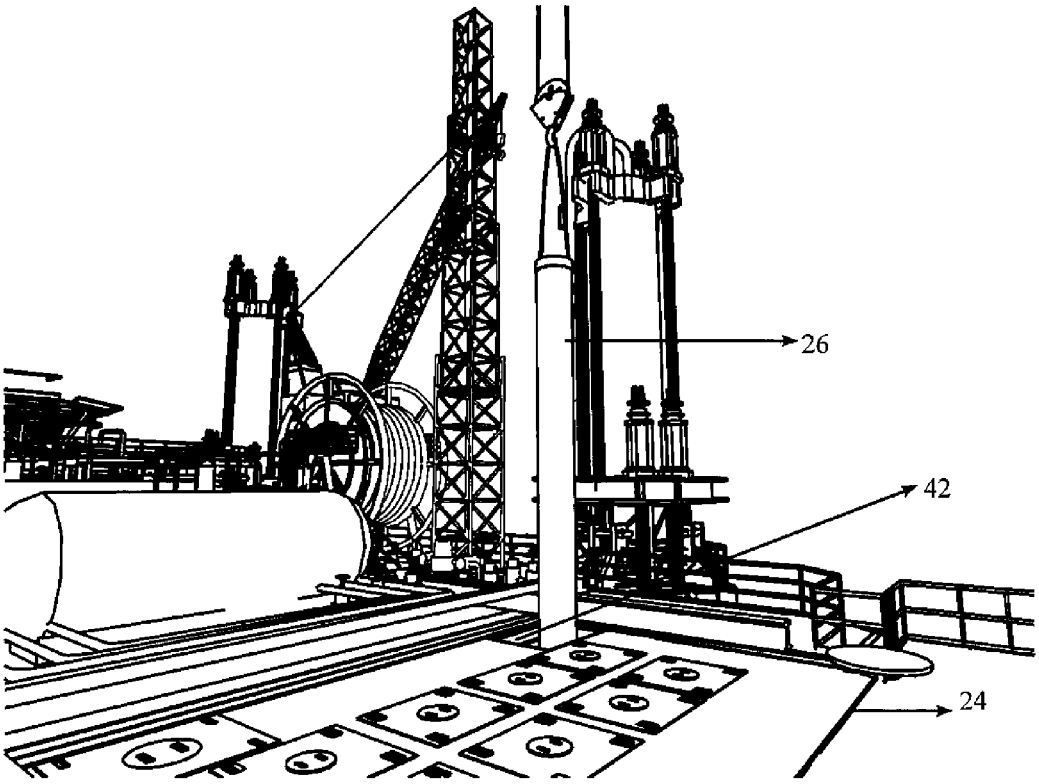
FIG. 5 shows a diagrammatic view of the structural conductors being stabbed-into a corner slot using platform crane.
Figure 6:
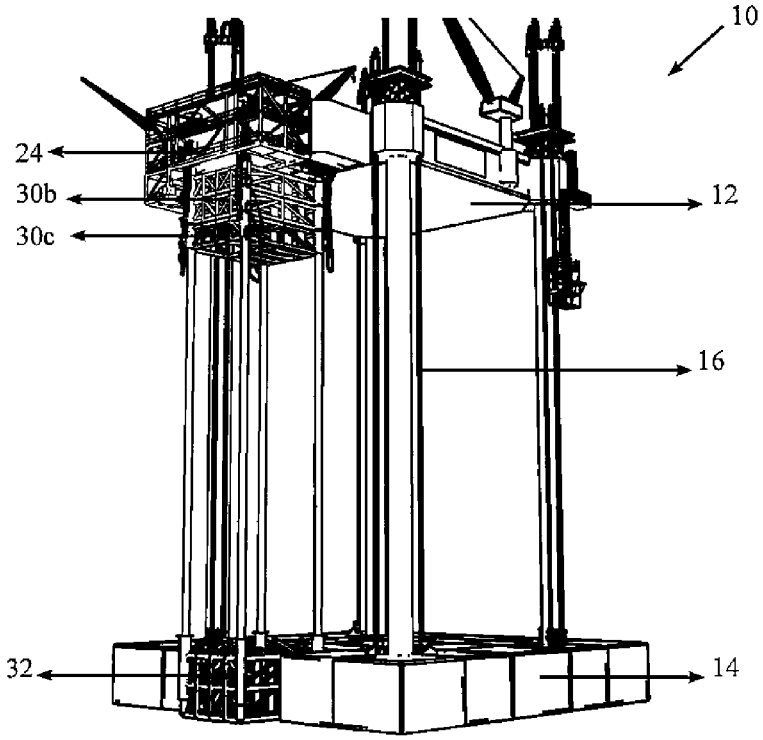
FIG. 6 shows a diagrammatic view of the structural conductors installed up to self penetration.
Figure 7:
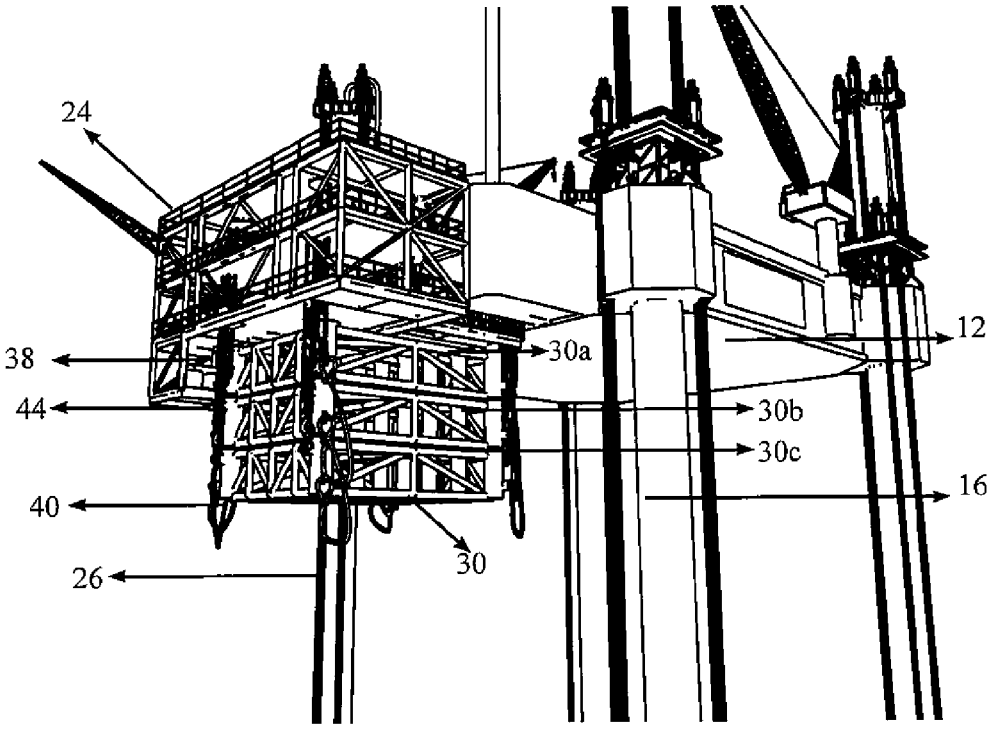
FIG. 7 shows a close-up view of the structural conductors stabbed-in through the stacked mid-span conductor frames.
Figure 8:
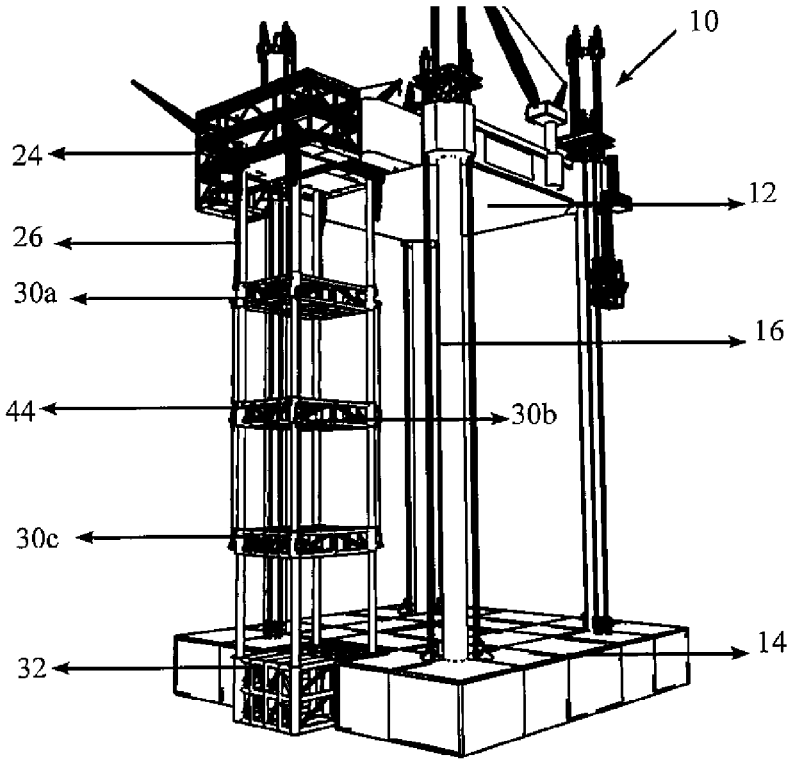
FIG. 8 shows a diagrammatic view of the mid-span conductor frames lowered down to pre-determined elevations.
Figure 9:
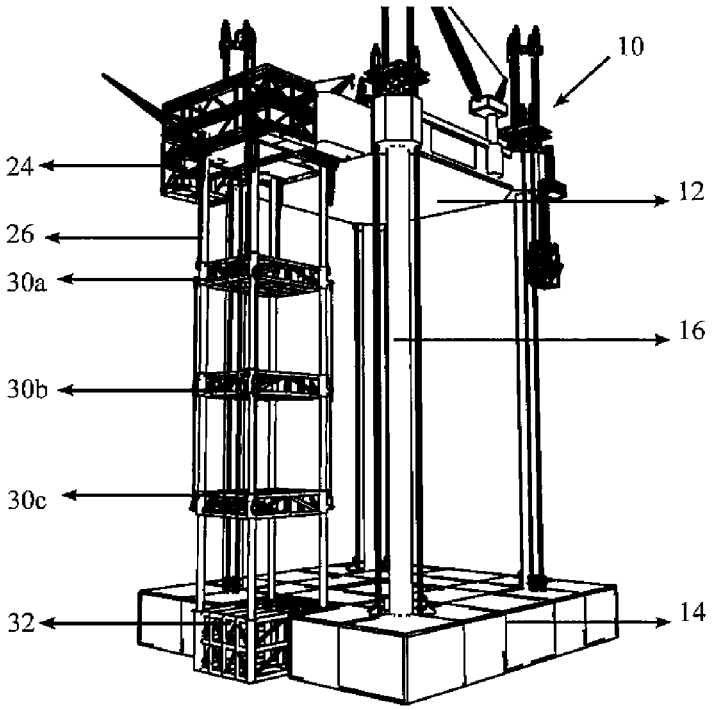
FIG. 9 shows a diagrammatic view of the rigging removed from mid-span conductor frames and ready to receive additional conductors.
Figure 10:
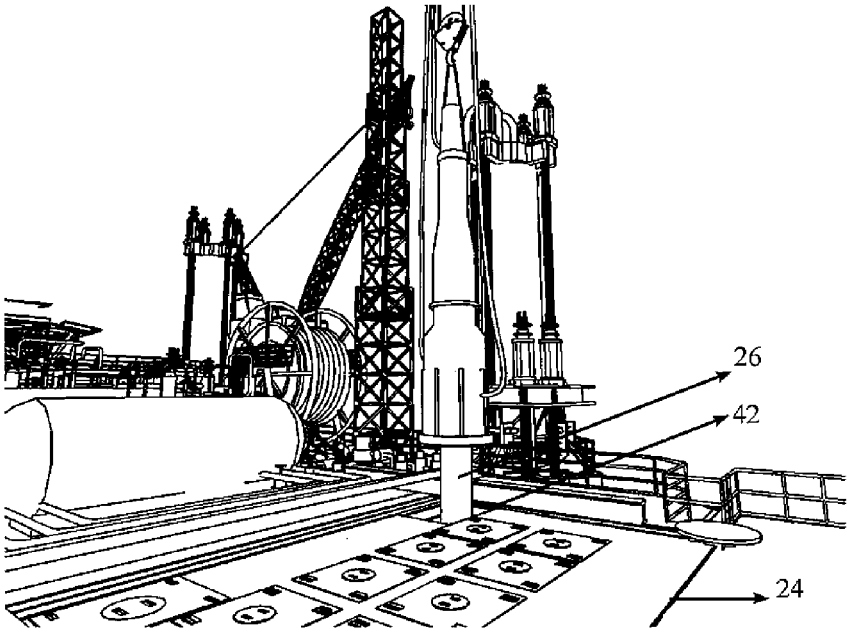
FIG. 10 shows a diagrammatic view of the conductor driving operation using hydraulic hammer held by self-elevating mobile platform's crane.
Figure 11:
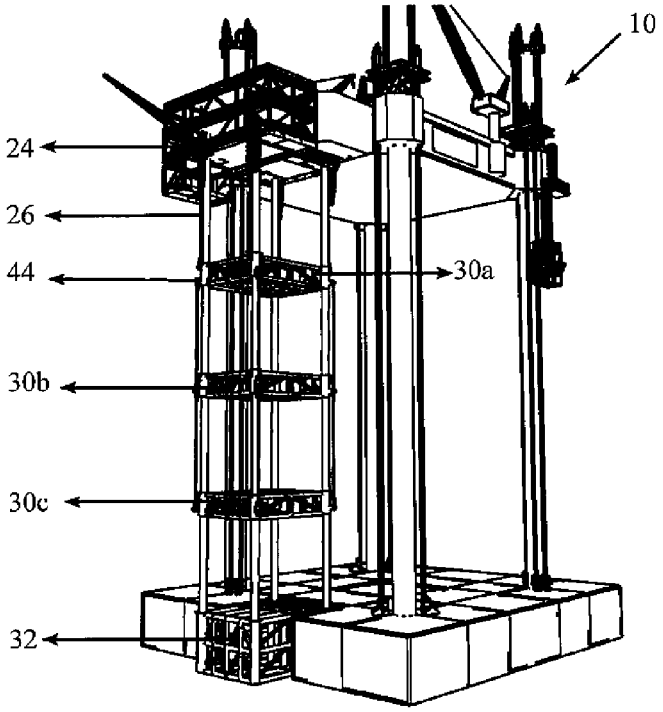
FIG. 11 shows a diagrammatic view of the wellhead platform with all conductors installed.

FIGS. 1 and 2 are diagrammatic views illustrating the wellhead platform (22) fabricated components for the first configuration described above, namely the wellhead deck (24) and sub-sea conductor frame (32), attached to one of the self-elevating mobile platform (10) described in (i) in its as-installed position. Generally, the hull (12) includes facilities for drilling and processing hydrocarbons, utilities, accommodation quarters, helideck, offices and other facilities. The at least one connecting leg (16) penetrate into the mat (14) and transfer load through a reticulated network of stiffeners. This enables the mat (14) to take load from topsides through the at least one connecting leg (16) onto sea bed. The mat of the self-elevating mobile platform includes storage for storing crude oil, water, chemicals, air and/or other fluids, hereinafter referred to as fluids. The integral storage of fluids allows the self-elevating mobile platform to operate without a pipeline network or floating storage and offloading vessel. The mat is compartmentalized to provide redundancy in case of damage to a compartment or to store different types or grades of fluids. The at least one connecting leg (16) also act as conduits as they contain piping to transport crude oil, water, mud, chemicals and other liquids, air and other gases between the mat (14) and the topsides facilities, eliminating the need for sub-sea connections that pose health, safety and environmental risks from potential leaks. Hydrocarbon fluids are then offloaded directly from the mat (14) through the piping in the at least one connecting leg (16) via floating hoses and mooring hawser deployed from the hull to shuttle tankers.

The wellhead deck accommodates wellheads, manifolds, headers, launchers, receivers and other utilities to collect the hydrocarbons from wells and feed them into production facilities and to increase hydrocarbon flow rates. The wellheads are mounted on conductors containing drilling casings. The sub-sea conductor frame (32) guides conductor installation and also provides support for the conductors.

Figure 20A:
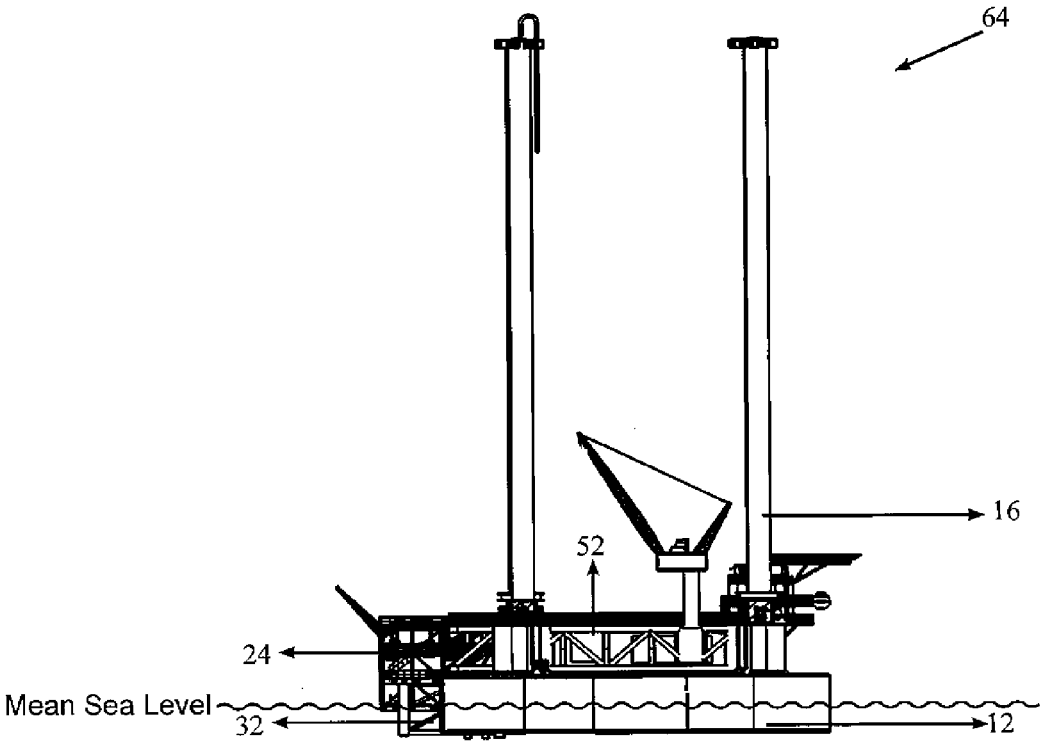
FIG. 20*a* shows a diagrammatic view illustrating the self-elevating mobile platform with a mat, wellhead deck, sub-sea conductor frame, at least one connecting leg and deck frame for topsides in towing condition to offshore installation site.
Figure 20B:
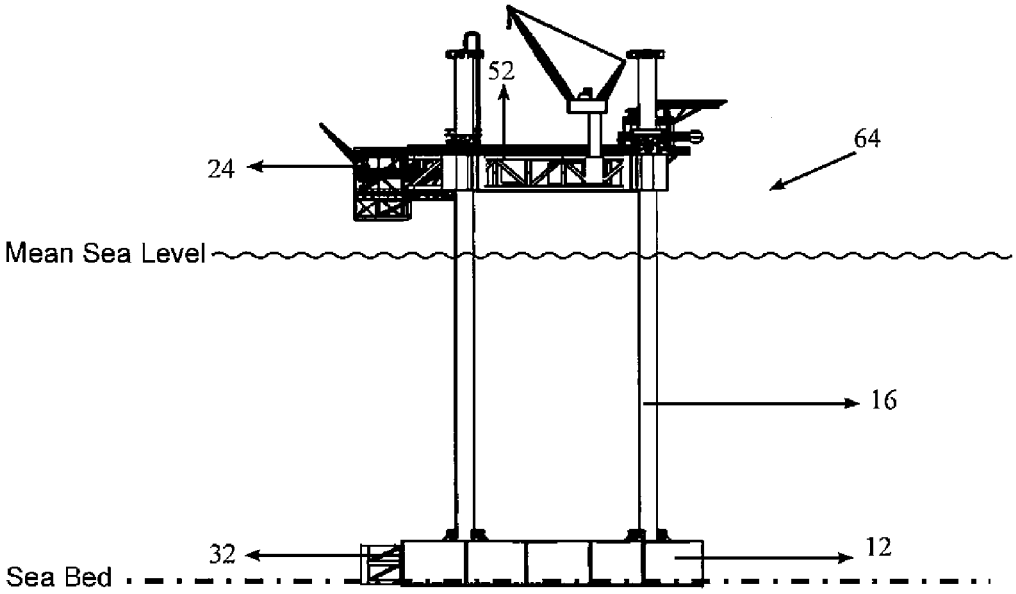
FIG. 20*b* shows diagrammatic view illustrating the self-elevating mobile platform with a mat, wellhead deck, sub-sea conductor frame, at least one connecting leg and deck frame for topsides being installed at offshore installation site.
Figure 21A:
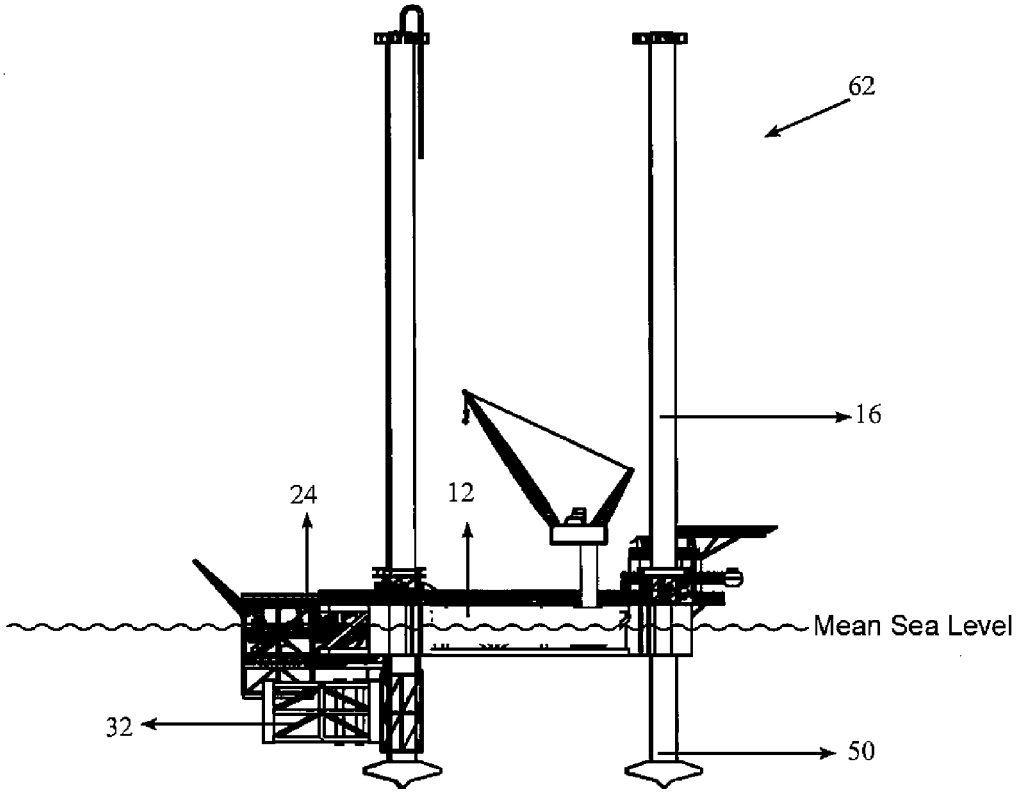
FIG. 21*a* shows a diagrammatic view illustrating the self-elevating mobile platform with spud cans attached to the at least one connecting leg, wellhead deck, sub-sea conductor frame and hull to accommodate topsides in towing condition to offshore installation site.
Figure 21B:
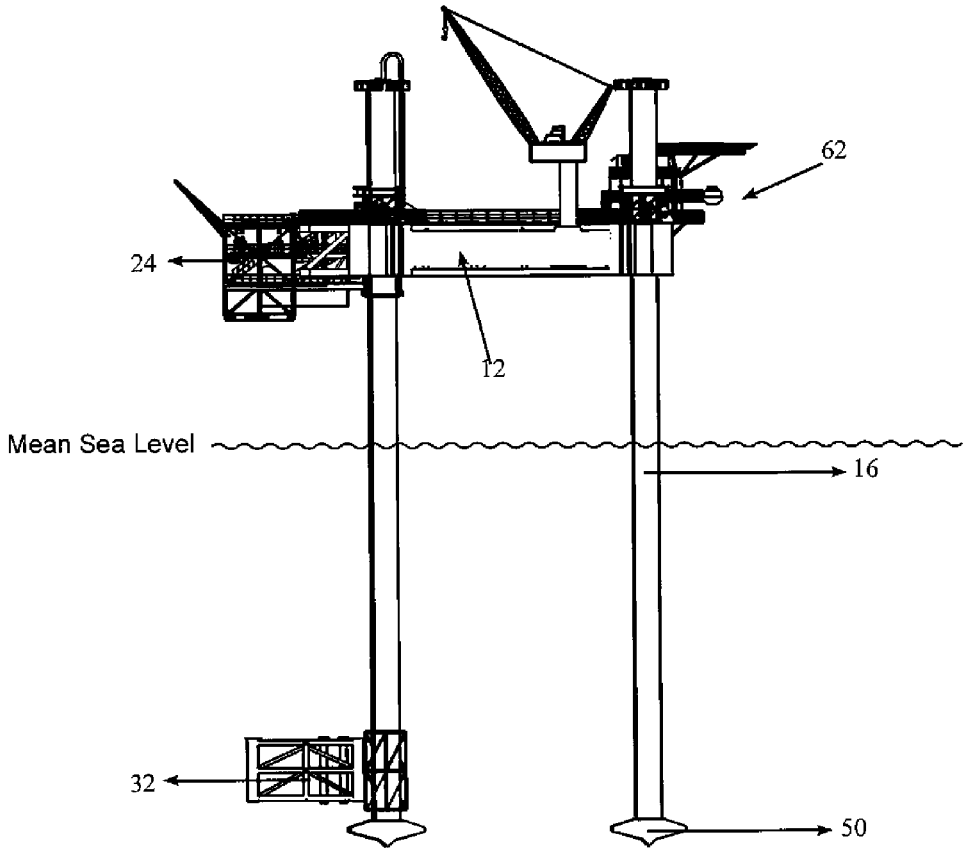
FIG. 21*b* shows a diagrammatic view illustrating a self-elevating mobile platform with spud cans attached to the at least one connecting leg, wellhead deck, sub-sea conductor frame and hull to accommodate topsides being installed at offshore installation site.
Figure 22A:
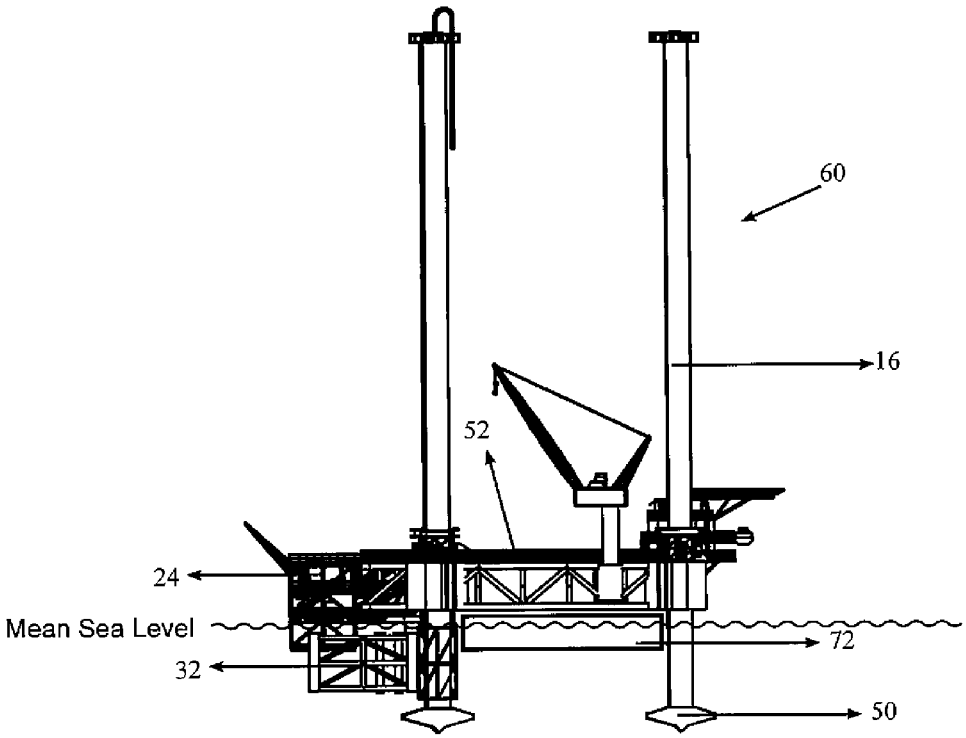
FIG. 22*a* shows a diagrammatic view illustrating the self-elevating mobile platform with spud cans attached to the at least one connecting leg, wellhead deck, sub-sea conductor frame and deck frame for topsides in towing condition to offshore installation site.
Figure 22B:
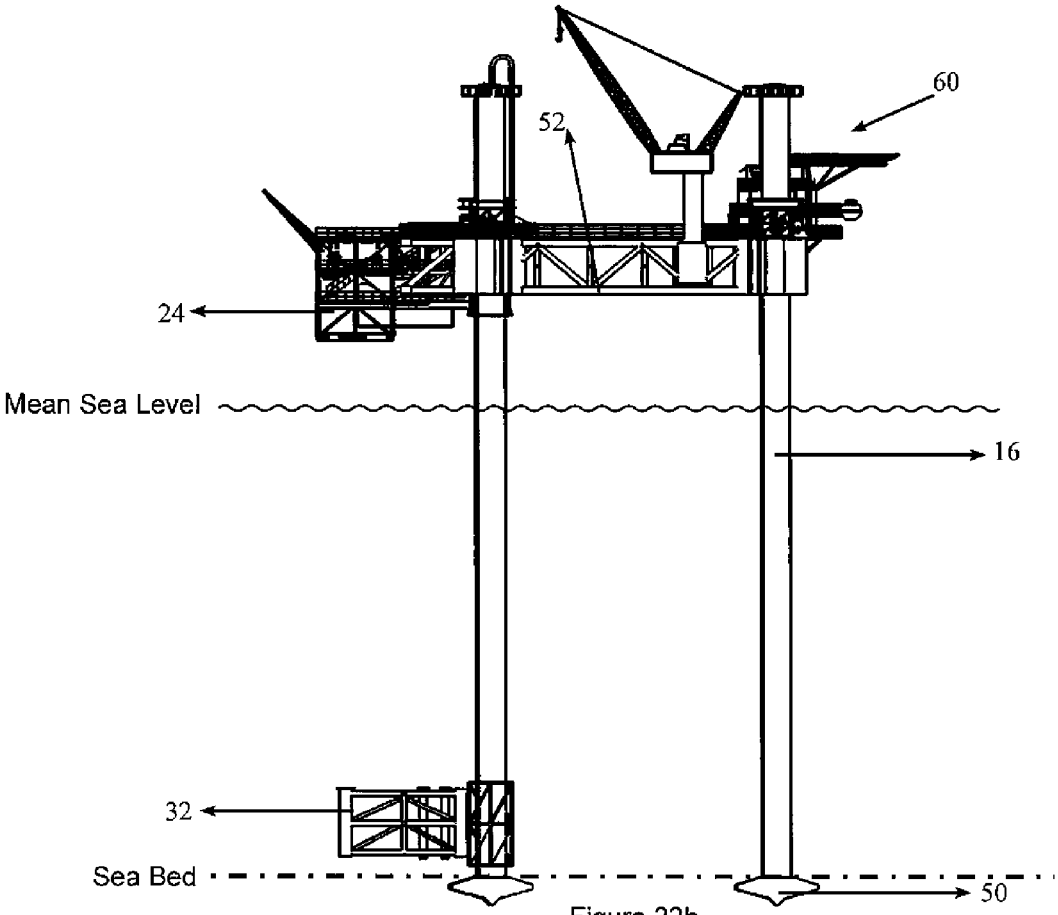
FIG. 22*b* shows a diagrammatic view illustrating the self-elevating mobile platform with spud cans attached to the at least one connecting leg, wellhead deck, sub-sea conductor frame and deck frame to accommodate topsides being installed at offshore installation site.

FIGS. 20(*a*), 20(*b*), 21(*a*), 21(*b*), 22(*a*), 22(*b*) illustrate other variants of the self-elevating mobile platform that may be used instead of that illustrated in FIGS. 1 and 2. The FIGS. 20*a*, 20*b*, 22*a*, and 22*b* show a deck frame (52) which is used as well instead of the hull (12).

FIGS. 21*a*, 21*b*, 22*a*, and 22*b* show a spud can (50) attached to each of at least one connecting leg (16) which is used as well instead of the mat (14). The deck frame (52) is used to house topsides facilities instead of the hull (12) and the spud can (50) replaces the mat (14) as the foundations.

Alternatively, submersible (70) and semi-submersible platform (58) can also be used instead of self-elevating mobile platforms (10, 60, 62, 64). FIGS. 23(*a*) and 23(*b*) illustrate a typical semi-submersible platform (58) with wellhead deck (24), sub-sea conductor frame (32). FIGS. 24(*a*) and 24(*b*) illustrate a typical submersible platform with wellhead deck (24), sub-sea conductor frame (30) attached and stacked-up underneath the wellhead deck (24).

The drilling template is to be used to build a wellhead platform to support conductors (26) or a caisson (28) containing drilling casings. A caisson (28) can be preinstalled onto the self-elevating mobile platform (10, 60, 62, 64) at fabrication site and towed to offshore installation site together with the self-elevating mobile platform (10, 60, 62, 64). The caisson (28) is clamped at the mat (14) or to the at least one connecting leg, wherein a spud can (50) is attached to each of the at least one connecting leg (16), or the lower hull (18) for the semi-submersible platform (58) or submersible platform and secured at the wellhead deck (24) during tow to offshore installation site. The FIG. 25*a*, 25*b*, 26*a*, 26*b*, 27*a*, 27*b*, 28*a*, 28*b* show the self-elevating platforms (10, 60, 62, 64) in its tow conditions and installed position at the offshore installation site. FIGS. 29*a*, 29*b*, 30*a*, 30*b* shows the semi-submersible platform and submersible platform in its tow conditions and installed position at the offshore installation site. Alternatively, instead of pre-installing a caisson (28) onto the self-elevating mobile platform (10, 60, 62, 64), conductors (26) can be driven or drilled through the self installing drilling template, and casings run inside the conductors (26) instead of the caisson (28). The self-elevating mobile platform supports both the above options for the self installing drilling template.

The self-elevating mobile platform (10, 60, 62, 64) is self-installing and thus timing for installation and de-installation does not have to coincide with availability of a derrick barge or a jack-up drilling rig. The self-elevating mobile platform (10, 60, 62, 64) includes a hull (12) and/or deck frame (52) and a mat (14) attached to at least one connecting leg (16) or a spud can (50) attached to each of at least one connecting leg (16). The hull (12) and/or deck frame (52) and the mat (14) or the spud can (50) are connectable with at least one connecting leg (16). The mat (14) includes a minimum of compartment for use as a one ballast chamber or for storage of fluids, each connectable to one terminal end region of each connecting leg (16) upstanding from the ballast chamber to above the hull (12). The ballast chamber is integrated to form a steel mat which will be used for stability during towing and installation/de-installation of the self-elevating mobile platform (10, 60, 62, 64).

The method of installing the wellhead platform (22) is now described. The self-elevating mobile platform (10, 60, 62, 64), comprising of the hull (12) and/or deck frame (52), mat (14) attached to at least one connecting leg (16) or a spud can (50) attached to each of at least one connecting leg (16), caisson (28) for the option without structural conductors (26), wellhead deck (24) and caisson sub-sea clamp (20) or sub-sea conductor frame (32), is constructed and assembled at a fabrication yard and its quayside before towing to an offshore installation site as an integrated unit. Optionally the caisson (28) is transported to the installation site and installed onto the self-elevating platform using ballasting and hoisting means mounted on the self-elevating mobile platform (10, 60, 62, 64). This is also applicable to the submersible (70) and semi-submersible platform (58) will not be described herein.

Once the self-elevating mobile platform is assembled and ready for tow, strand jacks are installed and ballast levels in the hull (12) and/or deck frame (52) and the mat (14) attached to at least one connecting leg (16) or the spud can attached to each of at least one connecting leg is adjusted to achieve the required draft and trim for the tow to offshore installation site. Then the at least one connecting leg (16) attached to the mat (14) or the one spud can (50) attached to at least one connecting leg, caisson (28), flare tower, etc. are secured for the tow by sea-fastening. The fully assembled self-elevating mobile platform (10, 60, 62, 64) is then towed by one or two tugs. Upon reaching the offshore installation, the sea-fastening is removed and ballast levels adjusted to achieve even trim. The strand jacks are then activated and ballasting commences to lower the mat (14) attached to the at least one connecting leg (16) or the spud can (50) attached to the at least one connecting leg (16) and the caisson (28) to seabed. All the ballast chambers in the mat (14) are then fully ballasted to allow the mat (14) to sink. Once the mat (14) sinks into the seabed to achieve equilibrium, the sub-sea clamp (20) holding the caisson (28) is released to allow the caisson (28) to self-penetrate into the soil until it becomes self-standing. The sub-sea clamp (20) will then be re-activated to provide lateral support for the caisson (28). The hull (12) and/or deck frame (52) is then fully de-ballasted and jacked-up to the desired height to provide adequate air gap.

Figure 23A:
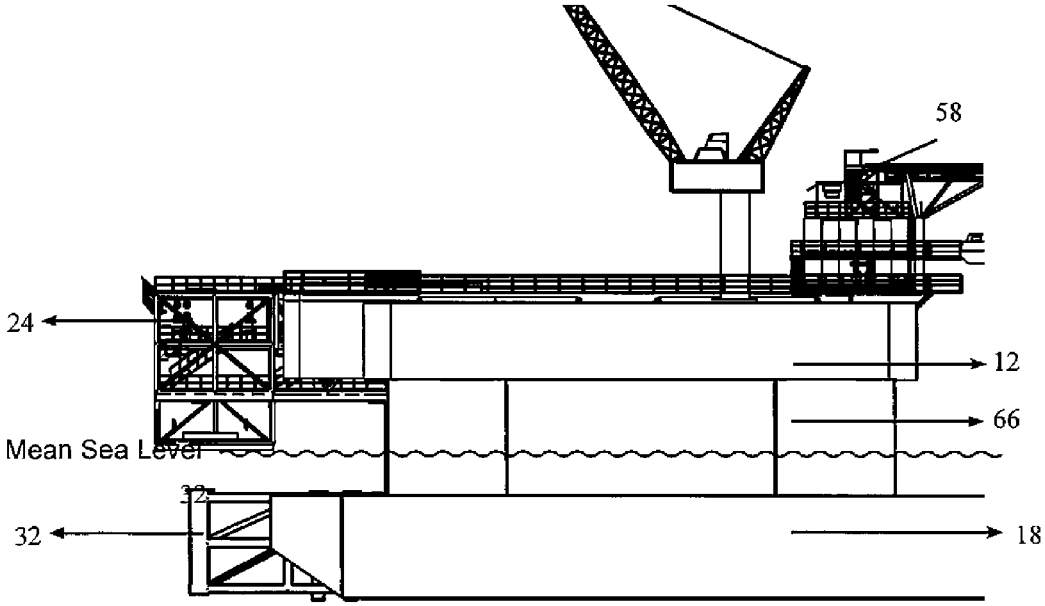
FIG. 23*a* shows a diagrammatic view illustrating the semi-submersible platform with hull, lower hull, at least one connecting means attached to the hull and lower hull, wellhead deck and sub-sea conductor frame in towing condition to offshore installation site.
Figure 23B:
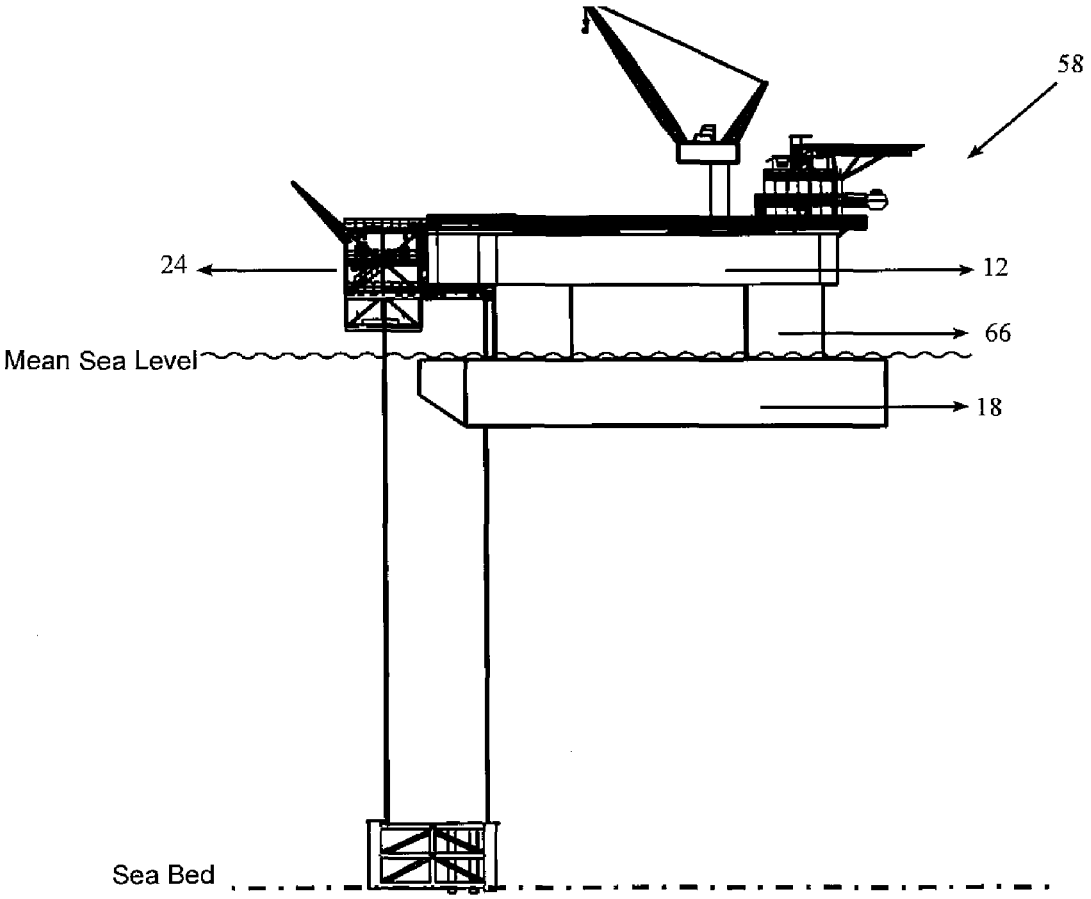
FIG. 23*b* shows a diagrammatic view illustrating the semi-submersible platform with hull, lower hull, at least one connecting means attached to the hull and lower hull, wellhead deck and sub-sea conductor frame being installed at offshore installation site.
Figure 24A:
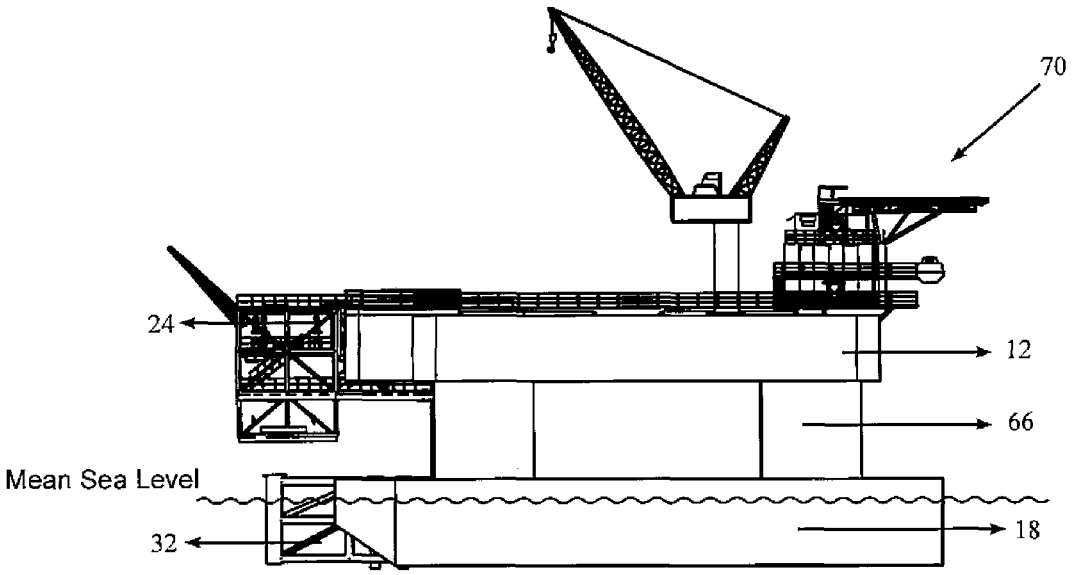
FIG. 24*a* shows a diagrammatic view illustrating the submersible platform with wellhead deck, hull, lower hull, at least one connecting means attached to the hull and lower hull and sub-sea conductor frame in towing condition to offshore installation site.
Figure 24B:
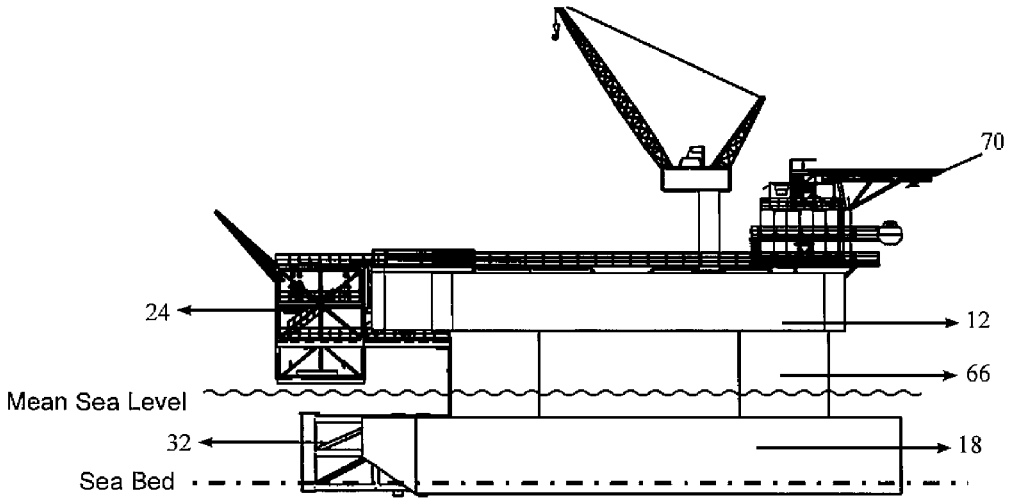
FIG. 24*b* shows a diagrammatic view illustrating the submersible platform with wellhead deck, hull, lower hull, at least one connecting means attached to the hull and lower hull and sub-sea conductor frame being installed at offshore installation site.
Figure 25A:
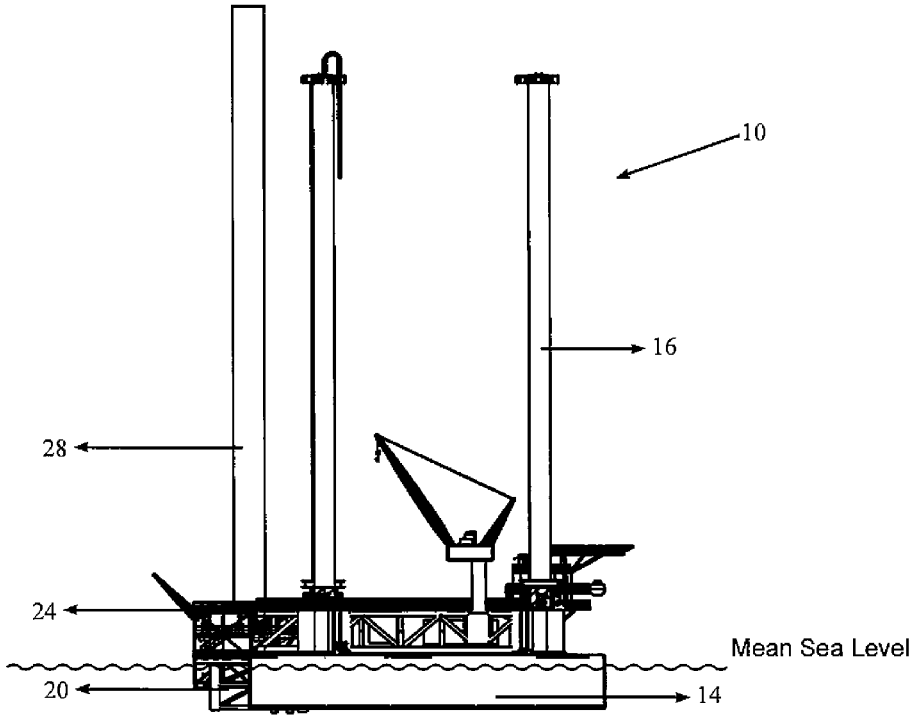
FIG. 25*a* shows a diagrammatic view illustrating the self-elevating mobile platform with a mat, wellhead deck, caisson, at least one connecting leg and hull to accommodate topsides in towing condition to offshore installation site.
Figure 25B:
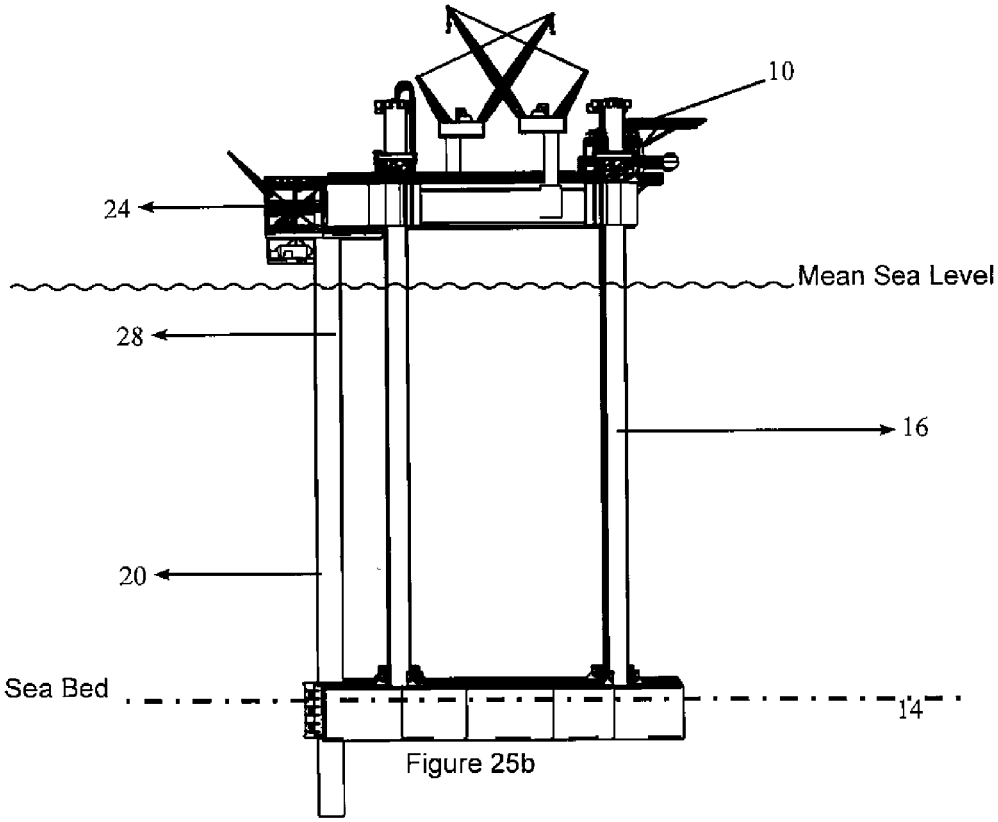
FIG. 25*b* shows a diagrammatic view illustrating the self-elevating mobile platform with a mat, wellhead deck, caisson, at least one connecting leg and hull to accommodate topsides being installed at offshore installation site.
Figure 26A:
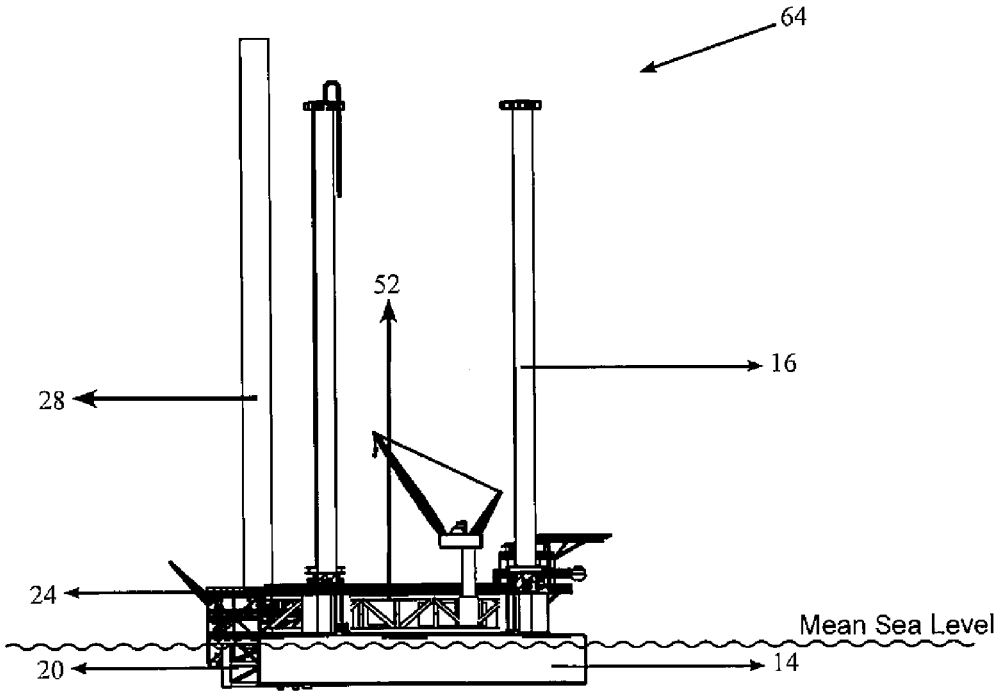
FIG. 26*a* shows a diagrammatic view illustrating the self-elevating mobile platform with a mat, wellhead deck, caisson, at least one connecting leg and deck frame for topsides in towing condition to offshore installation site.
Figure 26B:
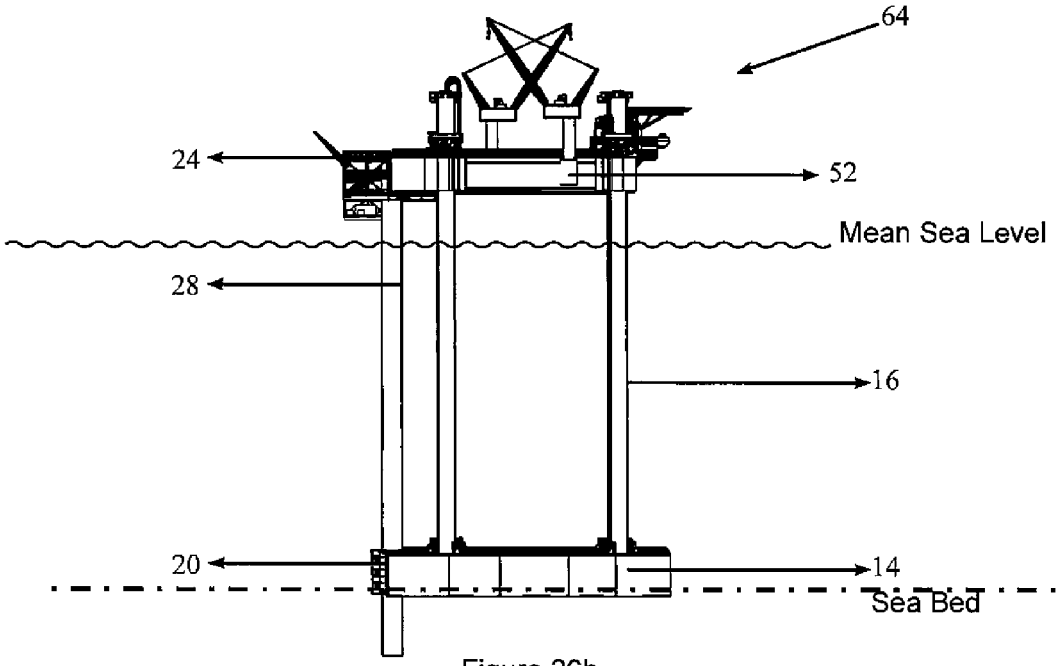
FIG. 26*b* shows a diagrammatic view illustrating the self-elevating mobile platform with a mat, wellhead deck, caisson, at least one connecting leg and deck frame for topsides being installed at offshore installation site.
Figure 27A:
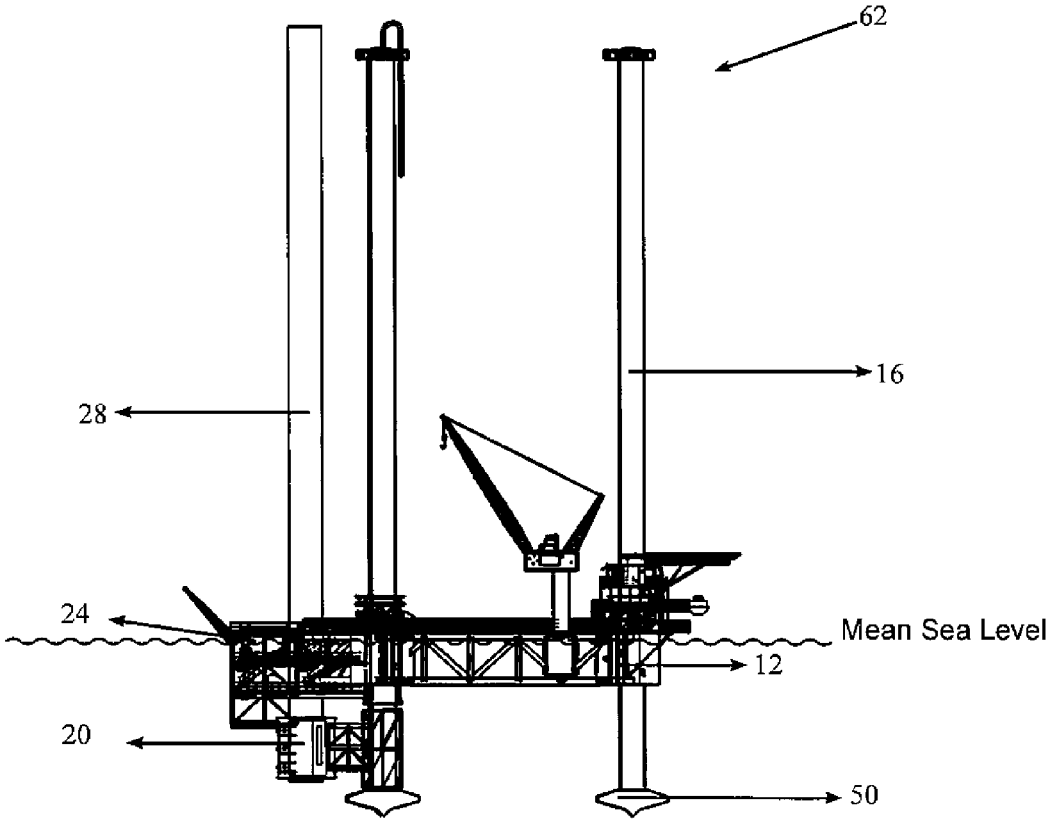
FIG. 27*a* shows a diagrammatic view illustrating the self-elevating mobile platform with spud cans attached to the at least one connecting leg, wellhead deck, caisson and hull to accommodate topsides in towing condition to offshore installation site.
Figure 27B:
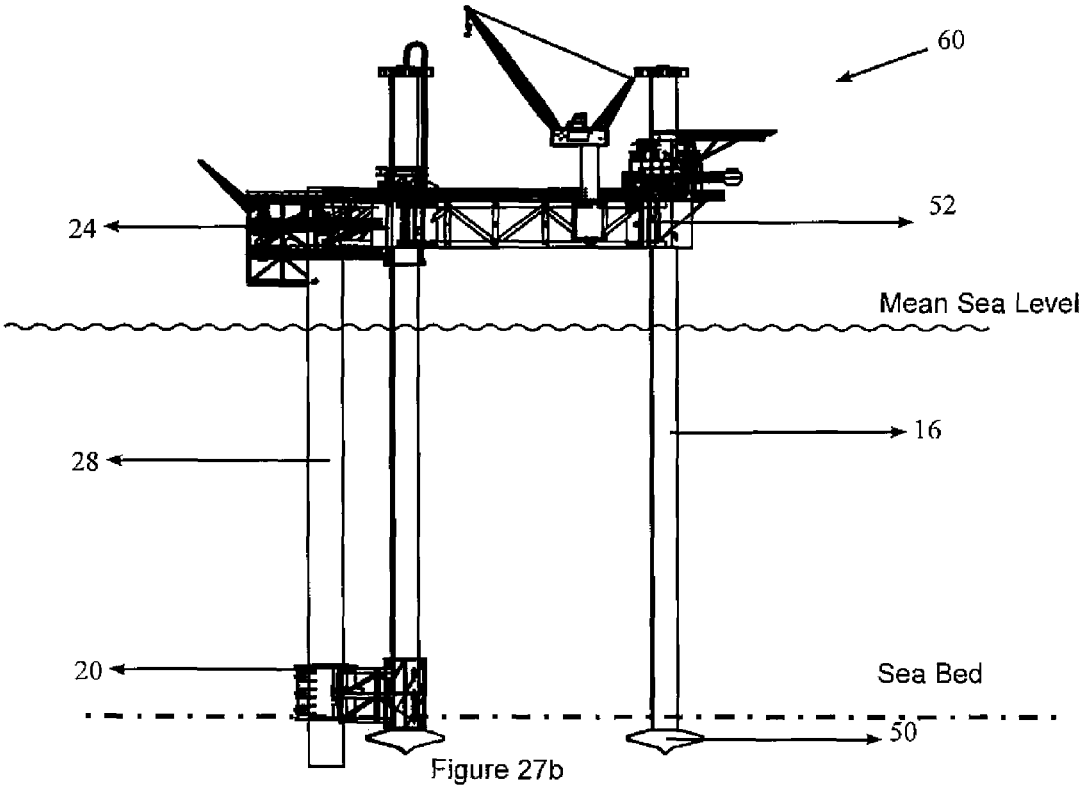
FIG. 27*b* shows a diagrammatic view illustrating a self-elevating mobile platform with spud cans attached to the at least one connecting leg, wellhead deck, caisson and hull to accommodate topsides being installed at offshore installation site.
Figure 28A:
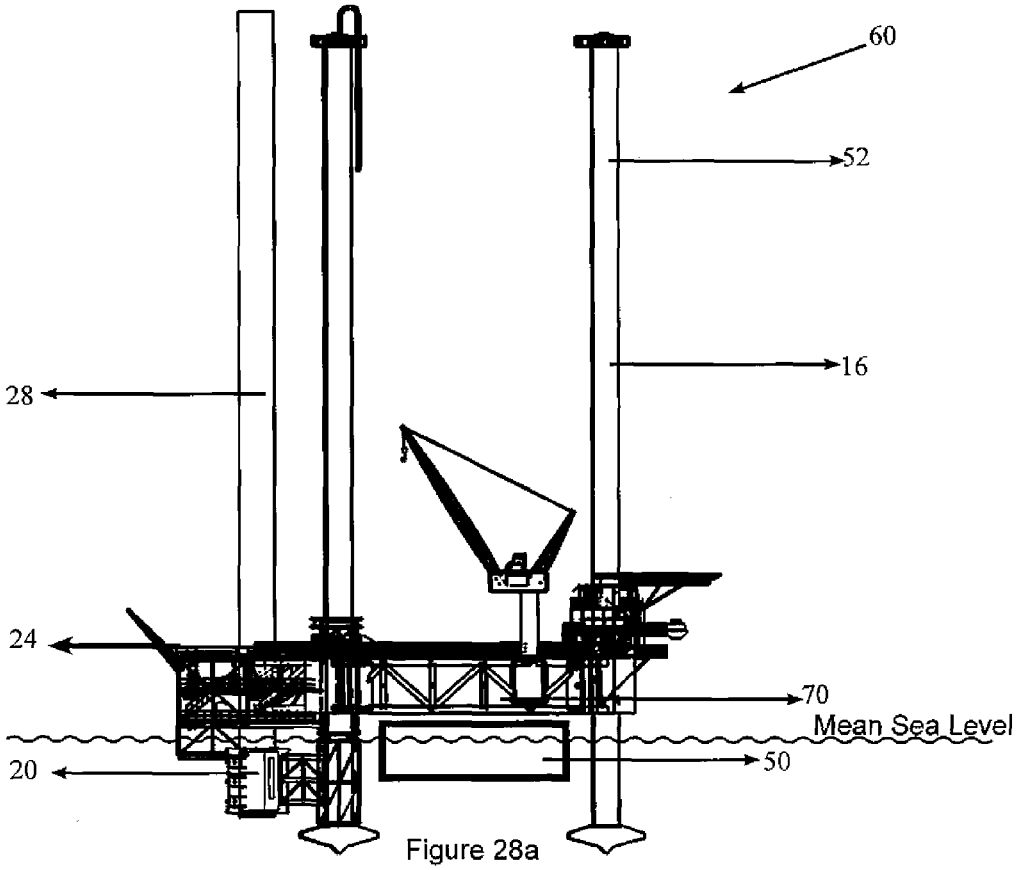
FIG. 28*a* shows a diagrammatic view illustrating the self-elevating mobile platform with spud cans attached to the at least one connecting leg, wellhead deck, caisson and deck frame for topsides in towing condition to offshore installation site.
Figure 28B:
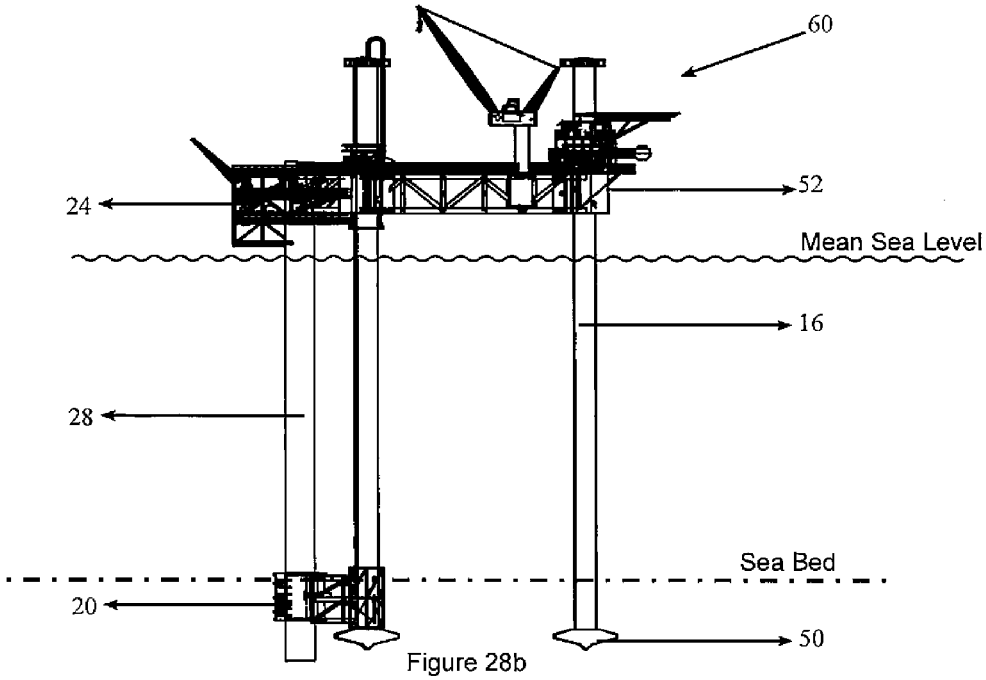
FIG. 28*b* shows a diagrammatic view illustrating the self-elevating mobile platform with spud cans attached to the at least one connecting leg, wellhead deck, caisson and deck frame for topsides being installed at offshore installation site.

As for the submersible platform (70) as shown in FIG. 24*a*, 24*b*, once the platform reaches the offshore installation site, the hull (12) and/or lower hull is ballasted until the lower hull (18) reaches the sea bed and predetermined soil bearing resistance is achieved. The other steps for installing the wellhead platform (22) are similar to the steps mentioned for the self-elevating mobile platform (10, 60, 62, 64). As for the semi-submersible platform (58) as shown in FIG. 23*a*, 23*b*, once the platform reaches the offshore installation site, the platform is secured to the sea bed and the other steps for installing wellhead platform remain similar to the steps mentioned for the self-elevating mobile platform and will not be described herein.

After the hull (12) and/or deck frame (52) is fully de-ballasted and jacked up to a predetermined height, the strand jacks are then deactivated and disconnected for use at another self-elevating mobile platform. The wellhead deck (24) is then secured to the caisson (28) by welding and prepared for drilling activities to extract hydrocarbons from the target reservoirs. The extracted hydrocarbons from the wellhead deck (24) are transported to the hull (12) and/or deck frame (52) for separation and stabilization before storing crude hydrocarbon in the mat (14). When all the hydrocarbon compartments fill-up, a shuttle tanker is mobilized and the hydrocarbon is offloaded using mooring hawsers and hoses.

The method of installing the self-elevating mobile platform (10, 60, 62, 64) for the at least one conductor option (26) is now described. The self-elevating mobile platform, comprising of the hull (12) and/or deck frame (52), mat (14) attached to at least one connecting leg (16) or a spud can (50) attached to each of at least one connecting leg, wellhead deck (24) and sub-sea conductor frame (32), is constructed and assembled at a fabrication yard and its quayside before towing to an offshore installation site as an integrated unit. The other steps after assembling the self-elevating mobile platform until it reaches the offshore installation site and lowering of the mat (14) attached to the at least one connecting leg (16) or a spud can (50) attached to each of the at least one connecting leg (16) to sea bed is similar to the caisson option will not be described herein. After that, the hull (12) and/or deck frame (52) will have to be jacked-up in order to support the conductor (26) installation. Once the hull (12) and/or deck frame (52) is jacked-up and secured in position, at least one mid-span conductor frames (30) will be stacked-up underneath the elevated wellhead deck (24) using elevating means mounted on the self-elevating mobile platform (10, 60, 62, 64) or the wellhead deck (24). Optionally the mid-span conductor frame is stacked -up on top of the sub-sea conductor frame (32). In order to perform this operation, pre-rigged mid-span conductor frames (30) will have to be stacked-up on a small barge, a workboat or an anchor handling tug, hereinafter called the vessel (34), and the vessel (34) positioned underneath the wellhead deck (24) by attaching polypropylene ropes (36) to the at least one connecting leg (16) and using the vessel's winches for more accurate maneuvering. Winches will be placed on the wellhead deck (24) and hooked-up to lugs (40) on a first mid-span conductor frame (30*a*) for hoisting up and securing underneath the wellhead deck (24). Chain blocks (38) attached to wellhead deck (24) will then be hooked-up to a second frame (30*b*) and lifted-up until it latches onto the first mid-span conductor frame (30*a*). Similarly, chain blocks (38) will then be hooked-up to a third mid-span conductor frame (30*c*) and lifted-up until it latches to the second frame (30*b*). The vessel (34) will then move away from the wellhead deck (24) area to allow conductor (26) installation. Optionally the at least one mid-span conductor frame (30) is stacked up underneath the wellhead deck (24) or on top of the sub-sea conductor frame (32) prior to towing of the self-elevating mobile platform (10, 60, 62, 64).

This installation method of wellhead platform (22) for conductor option also applies to the submersible (70) and semi-submersible platform (58). Installing of the at least one mid-span conductor frame (30) is optional. The necessity to install and the required number of mid-span frames is determined based on a few design parameters, including the water depth, meteorological and soil conditions at site, wellhead deck weight and the number, sizes and material properties of structural conductors to build the wellhead platform. Based on a study done for relatively benign environment in water depth of 67 m, three mid-span frames are required at approximately 15 m, 30 m and 45 m below sea level, when using four numbers of high strength steel structural conductors with outside diameters of 36 inches to support a 350 tones wellhead deck.

Figure 29A:
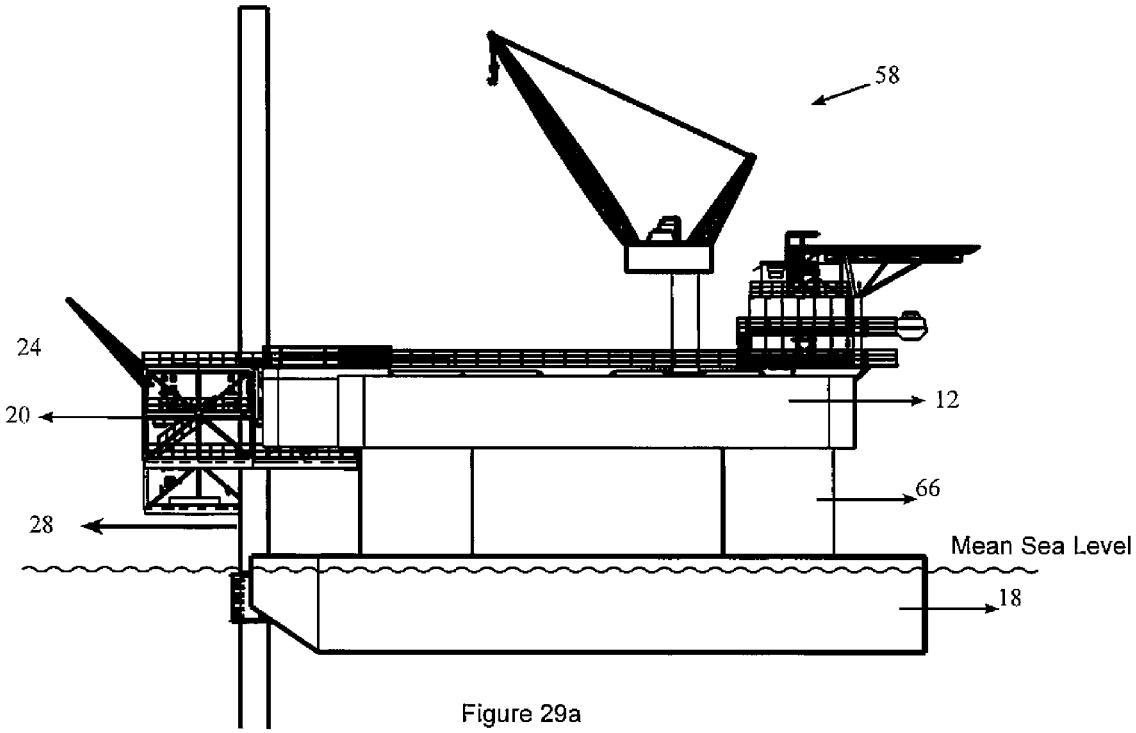
FIG. 29*a* shows a diagrammatic view illustrating the semi-submersible platform with wellhead deck, hull, lower hull, at least one connecting means attached to hull and lower hull and caisson in towing condition to offshore installation site.
Figure 29B:
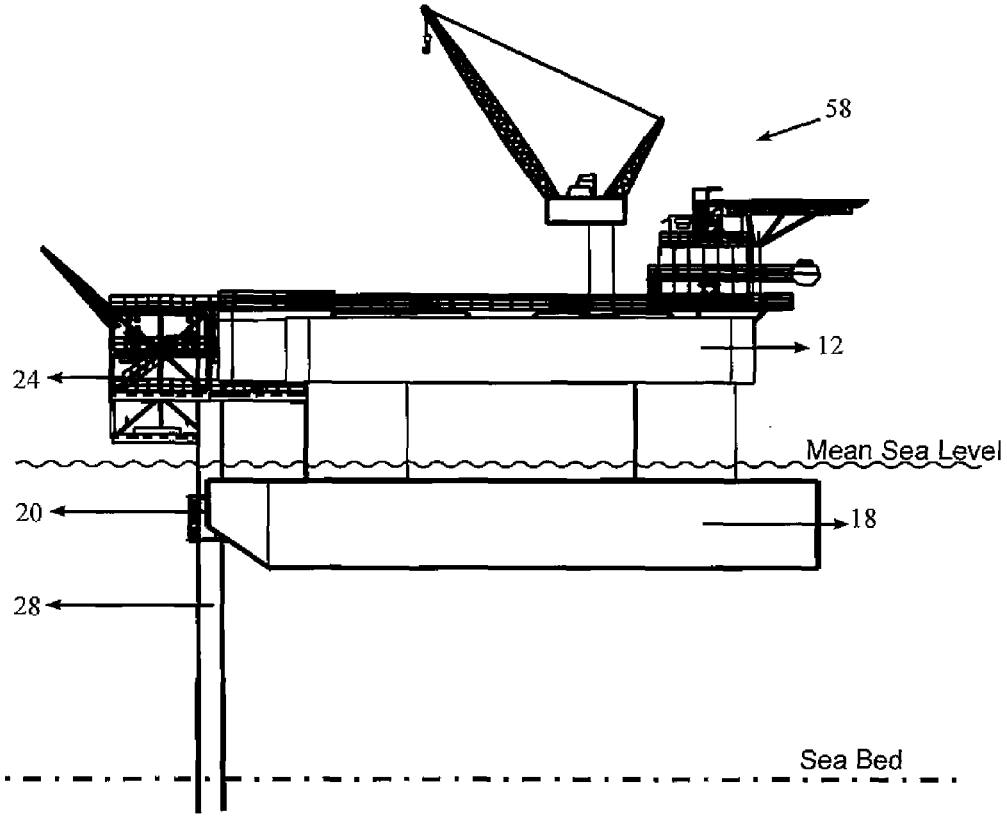
FIG. 29*b* shows a diagrammatic view illustrating the semi-submersible platform with wellhead deck, hull, lower hull, at least one connecting means attached to the hull and lower hull and caisson being installed at offshore installation site.
Figure 30A:
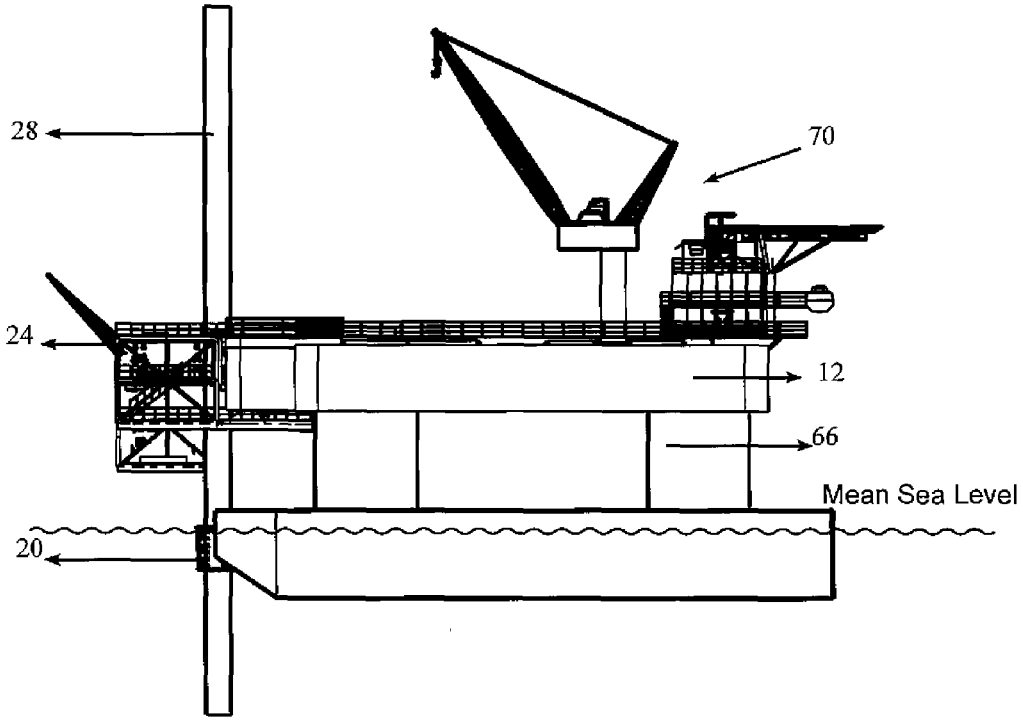
FIG. 30*a* shows a diagrammatic view illustrating the submersible platform with wellhead deck, hull, lower hull, at least one connecting means attached to the hull and lower hull and caisson in towing condition to offshore installation site.
Figure 30B:
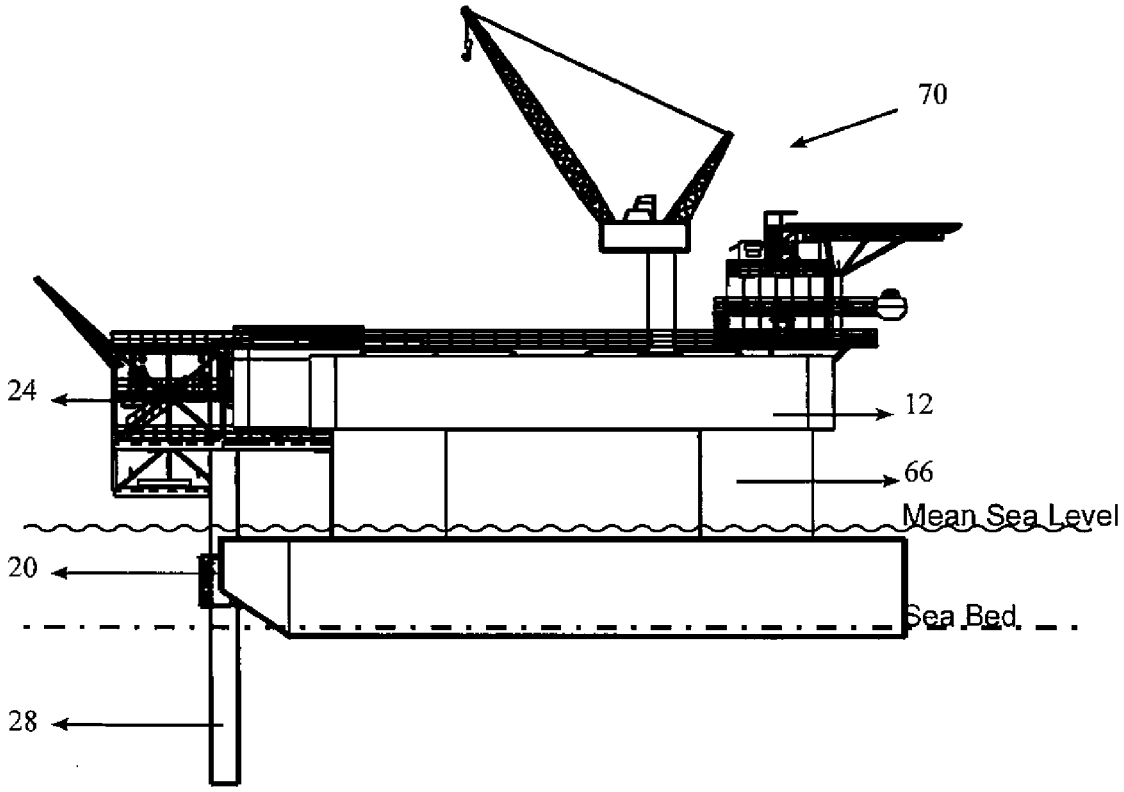
FIG. 30*b* shows a diagrammatic view illustrating the submersible platform with wellhead deck, hull, lower hull, at least one connecting means attached to the hull and lower hull and caisson being installed at offshore installation site.

As for the submersible platform (70) for the conductor option as shown in FIG. 30*a*, 30*b*, once the platform reaches offshore installation site, the hull (12) and/or lower hull (52) is ballasted until the lower hull (18) reaches sea bed and predetermined soil bearing resistance is achieved. The other steps for installing the wellhead platform (22) are similar to the steps mentioned above for the self-elevating mobile platform for conductor option and will not be described herein. As for the semi-submersible platform (58) as shown in FIG. 29*a*, 29*b*, once the platform reaches the destination, the platform is secured to the sea bed and lowering of the sub-sea conductor frame (32) to sea bed and the other steps remain similar to the steps mentioned above for the self-elevating mobile platform for conductor option.

Thereafter, at least four conductors (26) will be installed at corner slots (42) of the wellhead deck (22) using the platform crane. These corner conductors, hereinafter called structural conductors (26), will form structural legs and piles for the wellhead platform (22). The conductors (26) will be made-up of double random length seamless or welded tubular, connected either by mechanical connectors or full penetration welding. The structural conductors (26) will be stabbed into the corner slots (42) and will go through conductor guides (44) at the mid-span conductor frames (30) and will be built-up until they penetrate through the soil layers under their own weight to achieve adequate soil resistance, hereinafter called self-penetration.

Once all the structural conductors (26) achieve self-penetration, the mid-span conductor frames (30) can be lowered down along the at least one conductor (26) to a predetermined level or elevated from above the sub-sea conductor frame (32) to a predetermined level. The chain blocks (38) supporting the third mid-span conductor frame (30*c*) will be released until the lowest pre-rigged slings are in tension, thereafter these chain blocks are detached from the third frame (30*c*). Similarly, the chain blocks (38) supporting the second frame (30*b*) are released and detached. The winches hookedup to the first mid-span conductor frame (30*a*) will then be activated and all mid-span conductor frames (30) will be lowered down to pre-determined elevations. For the at least one mid-span frame (30) stacked on top of the sub-sea conductor frame (32), the least one mid span frame (30) is raised up to predetermined elevations.

The structural conductors (26) can then be driven to target penetration using hammer held by platform crane. Once target penetration is reached, the mid-span conductor frames (30) will be secured to the structural conductors (26) using securing means such as mechanical clamps or grouting. The rigging attached to the mid-span conductor frames (30) can then be safely removed.

The wellhead deck (24) will then be secured to the structural conductors (26) by welding. With this operation, the wellhead platform (22) can be considered structurally complete. FIGS. 3 to 11 and FIGS. 20*a*, 20*b*, 21*a*, 21*b*, 22*a*, 22*b* shows the method of installing the wellhead platform (22) using the self-elevating mobile platform (10, 60, 62, 64). The structural conductors (26), supported by the mid-span conductor frames (30) will effectively withstand the weight of the wellhead deck (24) and environmental loads once the self-elevating mobile platform is demobilized. Additional drilling conductors (64) can then be installed as required. These conductors (64) will only support wellheads/x-mas trees in addition to their self weight.

Figure 19:
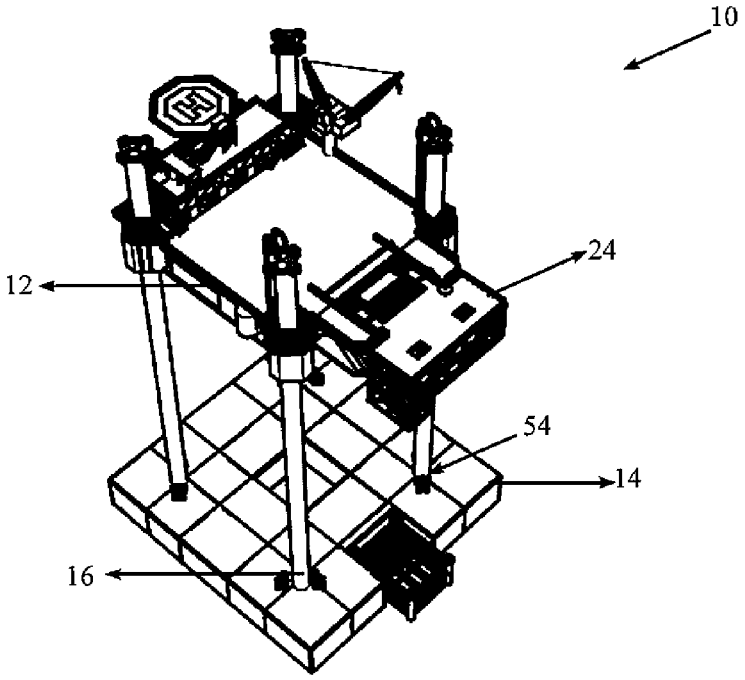
FIG. 19 shows a diagrammatic view of the wellhead platform components attached to self-elevating mobile platform in its as-installed position, with modular drilling rig and a drill stem test string deployed.

The present invention now further described another embodiment that relates to a method of installing a wellhead platform (22) for exploring hydrocarbons below sea bed at offshore installation site using the offshore unit (10, 60, 62, 64, 58, 70). The self installing drilling template described above is attached to the offshore unit (10, 58, 60, 62, 64, 70) at onshore site and towed to offshore installation site as a single unit for exploring hydrocarbons below sea bed. When exploration drilling is envisaged, conductors (26) will not be installed. Instead, drill stem test (DST) string (54) will be deployed to drill and complete a well and a subsurface valve will be used to flow in or shut the well. The drilling template supports the DST for exploring the hydrocarbon. Pressure gauges will be installed down hole to measure changes and typically instead of using a production tree, DST well control equipment will be utilized. FIG. 19 shows the self-elevating mobile platform (10) with modular rig and drill stem test string (DST) deployed. Drilling and well appraisal, including extended well testing can be performed with this configuration. Based on the results from the testing, recoverable reserves can be computed, flow rates will be measured and full scale development strategy can be formulated. This will then determine number of wells to be drilled and optimum process facilities required. If results of the appraisal and testing do not warrant a production facility at the site, the DST string (54) can be retrieved and the self-elevating mobile platform, including the self installing drilling template, can be redeployed to another suitable site. The DST string (54) is retrieved when cost of production is higher than cost of recoverable reserves. If the results of the appraisal and testing warrant a production facility at the site, the DST string (54) is retrieved and at least one conductor or caisson is installed for production to occur.

Figure 13:
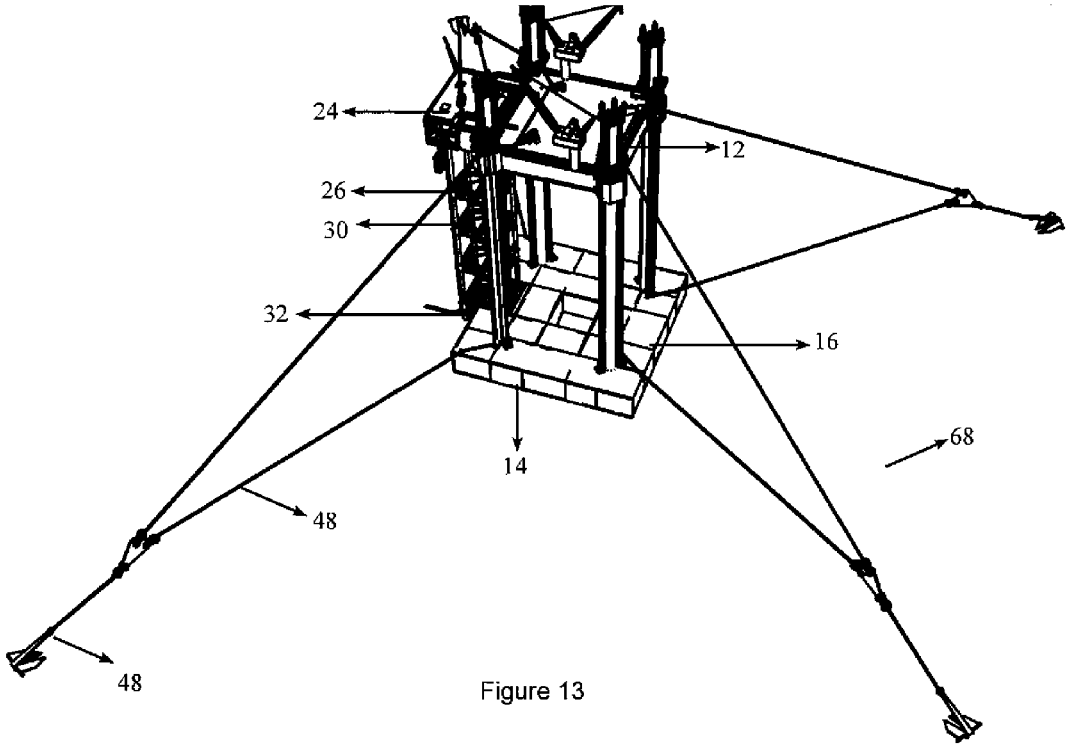
FIG. 13 shows a diagrammatic view of the pre-laid mooring system hooked-up to the hull and mat of the self-elevating mobile platform.
Figure 14:
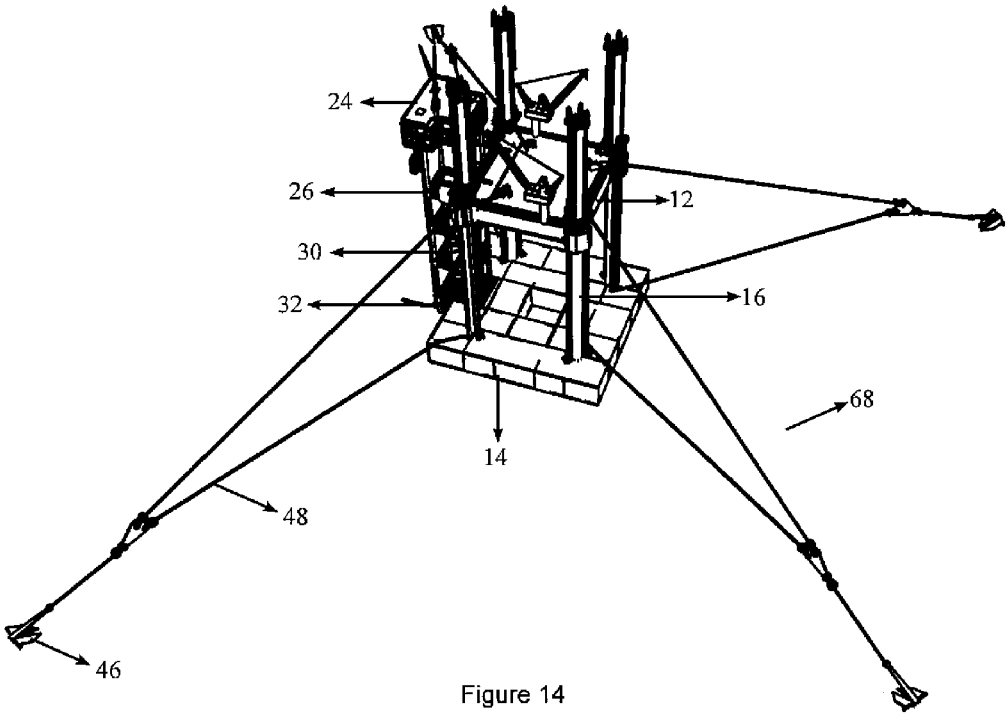
FIG. 14 shows a diagrammatic view of the hull being jacked-down to water level while maintaining tension in all mooring lines via winching.
Figure 15:
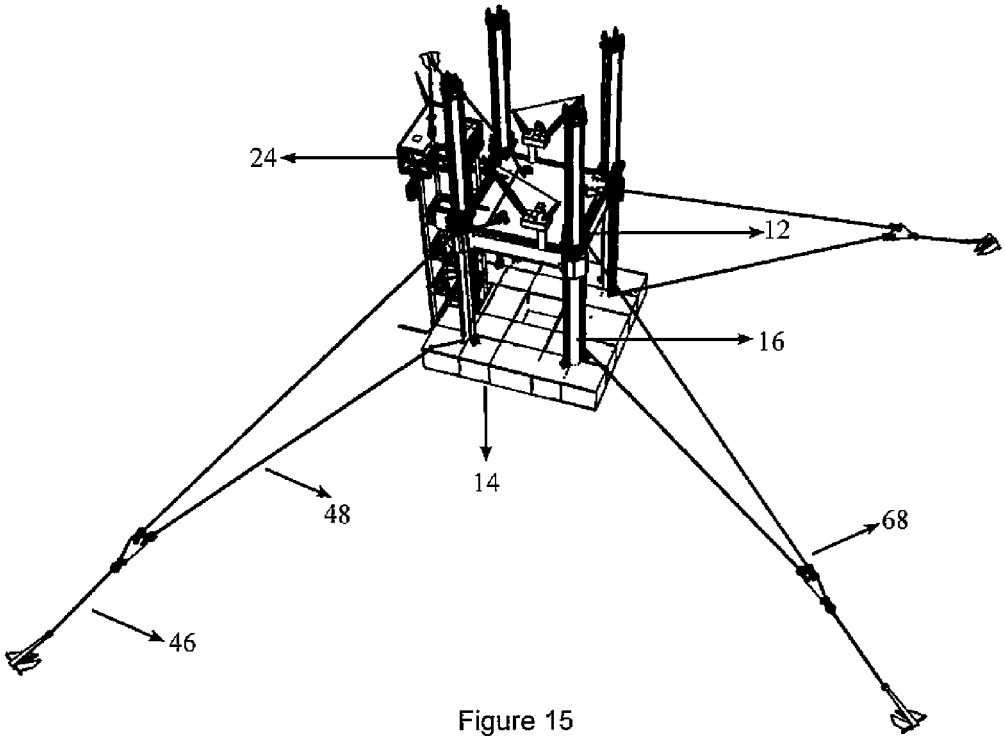
FIG. 15 shows a diagrammatic view of the mat being de-ballasted to clear seabed while maintaining tension in all mooring lines via winching.
Figure 16:
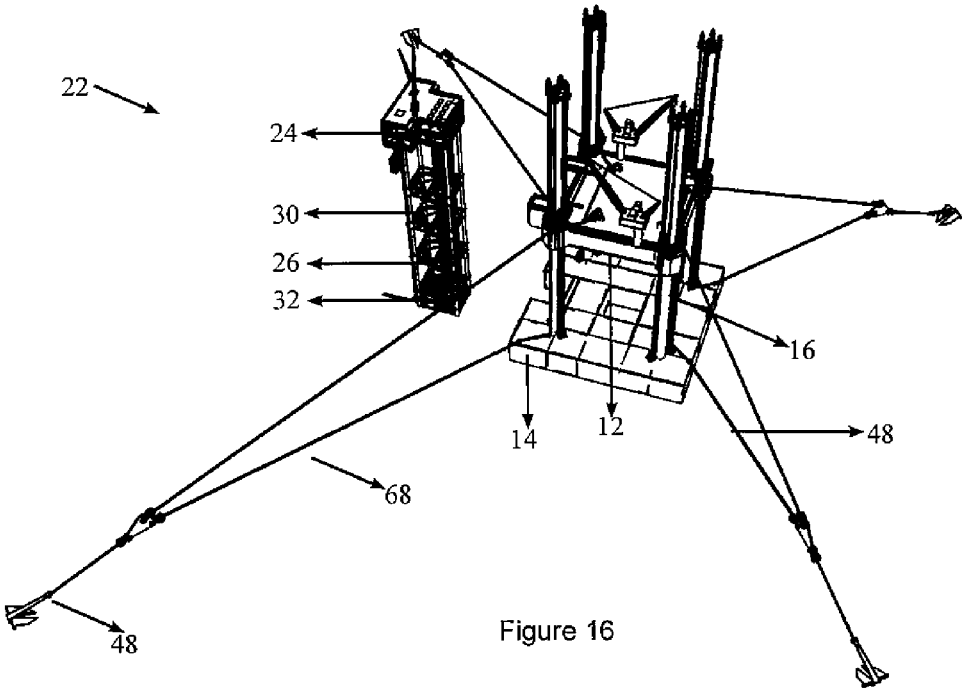
FIG. 16 shows a diagrammatic view of the self-elevating mobile platform being maneuvered away from wellhead platform by winching on two forward mooring lines while paying out on two aft lines.
Figure 17:
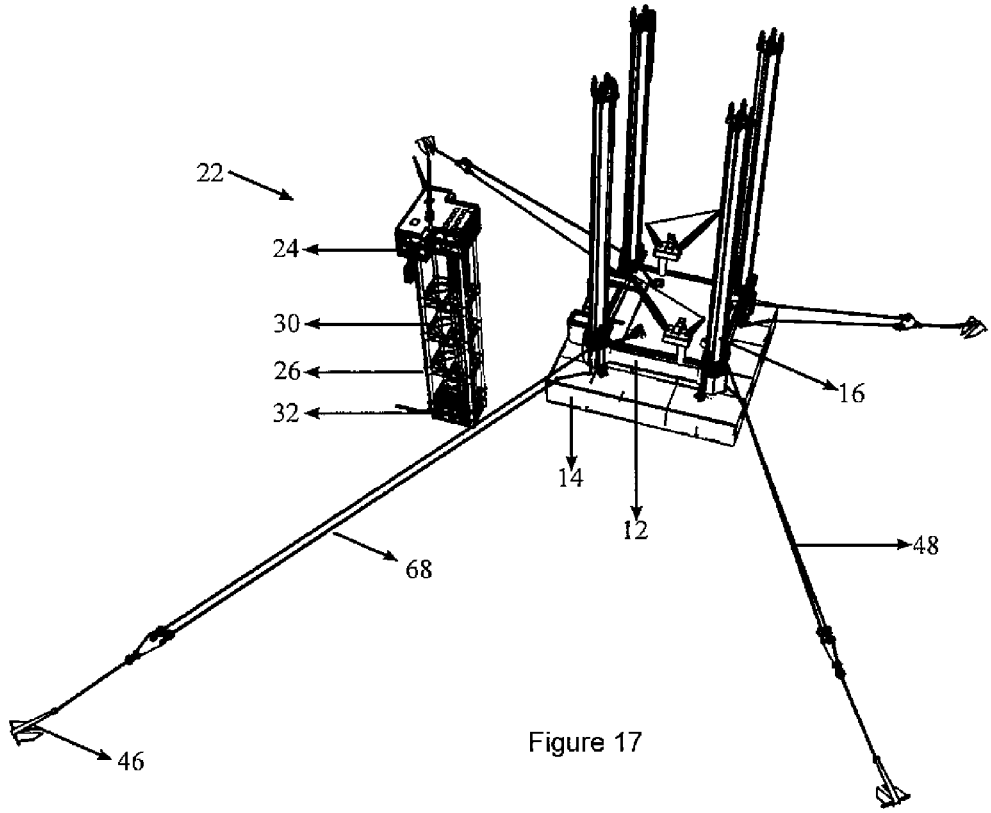
FIG. 17 shows a diagrammatic view of the mat being jacked-up to surface while maintaining tension in all mooring lines via winching.
Figure 18:
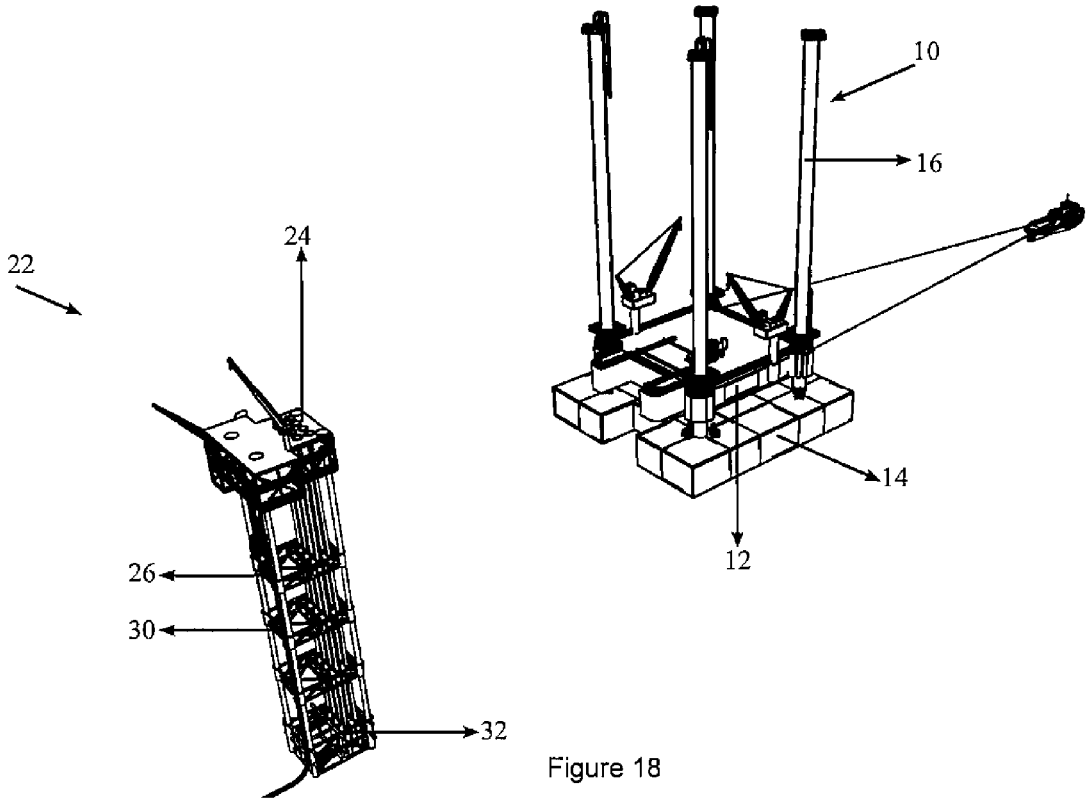
FIG. 18 shows a diagrammatic view of the self-elevating mobile platform disconnected from the pre-laid mooring system and hooked-up for towing.

The demobilization methodology of the self-elevating mobile platform will now be described and the demobilization methodology of the self-elevating mobile platform is shown in FIG. 13 to FIG. 18. The de-installation of the self-elevating mobile platform (10, 60, 62, 64) is essentially a reverse of installation procedure. However, before the deinstallation can commence, pre-laid mooring system (68) will have to be deployed and hooked-up to the mat (14) attached to the at least one connecting leg (16) or to at least one connecting leg where a spud can (50) is attached to each of the at least one connecting leg and to hull (12), where hull (12) or combination of hull (12) and deck frame (52) is used, or transportation means (72) for controlled maneuvering due to the proximity to live wells. The transportation means (72) is used where deck frame is used without a hull (12). The pre-laid mooring system consists of at least 4 sets of bridles (48) made-up of chains, wire-ropes, shackles and tri-plates, 2 sets of bridles (48) for aft, 1 each for port and starboard. Anchors (46), with bridles (48) attached, are dropped at predetermined locations. The bridles (48) are attached to buoys for retrieving and attaching to winch lines. Double-drum winches are placed on-board self-elevating mobile platform's hull (12) and/or deck frame (52) and winch lines inserted through fairleads, bollards and lugs on mat (14) attached to the at least one connecting leg (16) or to at least one connecting leg where a spud can (50) is attached to each of the at least one connecting leg and hull (12) and/or deck frame (52) or transportation means (72) when deck frame (52) is used. FIG. 13 shows a diagrammatic view illustrating the pre-laid mooring system (68) and winch line attachments.

De-commissioning of flow lines and manifolds, detachment of all piping and instrumentation lines and electrical cables between self-elevating mobile platform (10, 60, 62, 64) and wellhead platform (22), followed by detachment of wellhead platform (22) from self-elevating mobile platform structures will then take place.

Strand jacks can then be installed and strand blocks attached to mat (14) attached to the at least one connecting leg (16) or to at least one connecting leg where a spud can (50) is attached to each of the at least one connecting leg. Jacking system is then activated to lower the hull (12) down to water level or the deck frame (52) down onto transportation means (72) when deck frame is used without a hull. Ballasting of the hull (12) or transportation means (72) takes place next to achieve required draft. All winch and mooring lines are tensioned-up, and water jetting is done to break cohesive soils, adhesion to bottom of the mat (14) attached to at least one connecting leg (16) or the spud can (50) attached to each of the at least one connecting leg and any suction effect that may resist lift-off of the mat (14) attached to the at least one connecting leg (16) or the spud can (50) attached to each of the at least one connecting leg (16). Selective ballast chambers in the mat are then de-ballasted and pressurized before activating the strand jacks to lift the mat (14) or the at least spud can (50) attached to the at least one connecting leg (16) off seabed by approximately 2 m. When equilibrium is attained, winches are activated to maneuver the self-elevating mobile platform (10, 60, 62, 64) away from wellhead platform (22) to a safe distance. The mat (14) attached to the at least one connecting leg (16) or the spud can (50) attached to each of the at least one connecting leg (16) is then jacked-up until contact with the hull (12) or deck frame (52). The mat or the hull (12), where the hull is used without a mat or transportation means (72) where deck frame (52) is used without a hull or mat is then de-ballasted to achieve tow draft of approximately 5m and the pre-determined trim. The mooring system will then be disconnected from the mat (14) or the at least one spud can (50) attached to the at least one connecting leg (16) and from the hull (12) or transportation means (72) and tow rigging hooked-up for deployment to the next location.

Figure 12:
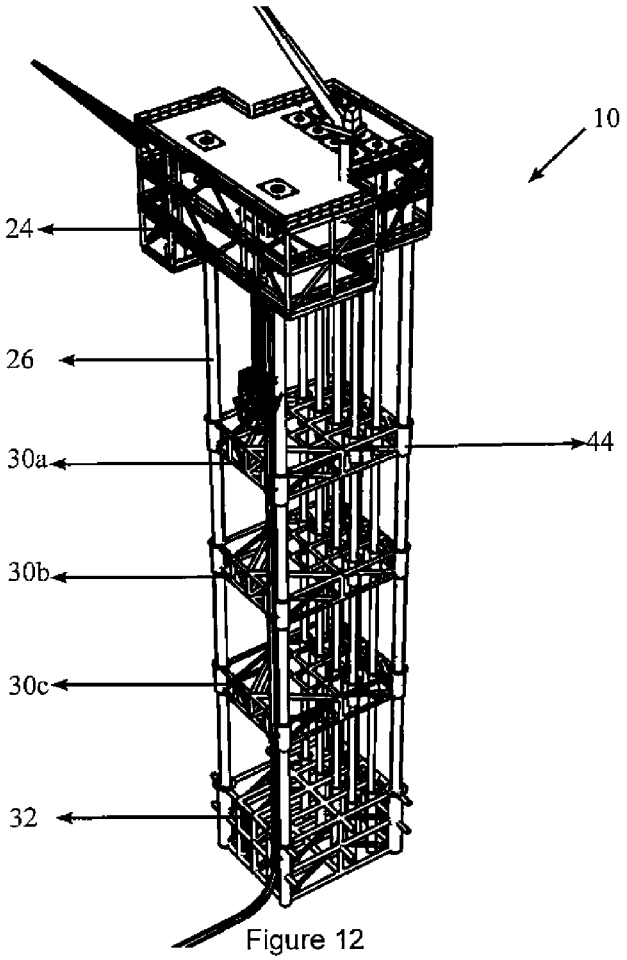
FIG. 12 shows a diagrammatic view of the detached wellhead platform in stand-alone mode.

The detached wellhead platform (22) will then be standalone for further well intervention and workovers or abandonment as shown FIG. 12. Further production can be planned with much higher certainty based on the performance achieved via the self-elevating mobile platform (10, 60, 62, 64). The wellhead platform (22) is capable of supporting risers for multi-phase crude export and gas lift/water injection import, riser guard/boat landing, crane, vent boom and drains, fire water and navigational systems to enable the platform to be operating in stand-alone mode.

The self-elevating mobile platform (10, 60, 62, 64) clearly from the descriptions above offers total flexibility at minimal cost by providing drilling to be carried out and upon completion allowing hydrocarbon processing to be carried out with the stabilized crude stored in the integrated storage tanks, all by the same platform. The self installing drilling template further offers scaling up or cost effective abandonment with the self-elevating mobile platform deployed elsewhere.

As may be recognized by those of ordinary skill in the pertinent art based on the teachings herein, numerous changes and modifications may be made to the above-described and other embodiments of the present disclosure without departing from the spirit of the invention as defined in the appended claims. Accordingly, this detailed description of embodiments is to be taken in an illustrative, as opposed to a limiting, sense.

What is claimed is:

1. A method of installing a wellhead platform which includes a wellhead deck, sub-sea conductor frame and at least one conductor using an offshore unit which offshore unit includes: a hull and/or a deck frame; a mat attached to at least one connecting leg or a spud can attached to each of at least one connecting leg or to a lower hull attached to at least one connecting means, wherein the method includes the steps of:

i) transporting the offshore unit to offshore installation site;

ii) installing the offshore unit;

iii) installing the at least one conductor through the wellhead deck and sub-sea conductor frame until the at least one conductor penetrates through soil layers to a target penetration; and iv) securing the wellhead deck to the at least one conductor;

wherein the wellhead deck is removably attached to the hull and/or deck frame;

wherein (a) where the offshore unit includes the mat, the sub-sea conductor frame is removably attached to the mat and (b) where the offshore unit includes the spud can, the sub-sea conductor frame is removably attached to the at least one connecting leg;

wherein the wellhead deck and sub-sea conductor frame are attached to the offshore unit while loading out and transporting the offshore unit from a fabrication site to an offshore installation site;

wherein the hull and/or deck frame and the mat or the spud can is connectable with the at least one connecting leg; and wherein the hull and/or deck frame and the lower hull is connectable with the at least one connecting means.

2. A method of installing a wellhead platform as claimed in claim 1, wherein the offshore unit is relocatable.

3. A method of installing a wellhead platform as claimed in claim 1 wherein, the offshore unit is capable of performing drilling, production, construction, accommodation, hook-up and commissioning or a combination of any of these functions thereof.

4. A method of installing a wellhead platform as claimed in claim 1, wherein step (ii) is optionally followed by stacking-up at least one means for supporting at least one conductor underneath the wellhead deck or on top of the sub-sea conductor frame.

5. A method of installing a wellhead platform as claimed in claim 1, wherein at least one means for supporting at least one conductor is either stacked-up underneath the wellhead deck or on top of the sub-sea conductor frame prior to the transporting of the offshore unit to the offshore installation site or the at least one means for supporting at least one conductor is transported to the offshore installation site by transportation means.

6. A method of installing a wellhead platform as claimed in claim 5, wherein the at least one means for supporting at least one conductor from the transportation means is hoisted up from the transportation means and stacked-up underneath the wellhead deck or lowered down on top of the sub-sea conductor frame by using an elevating means or lowering means mounted on the offshore unit or the wellhead deck.

7. A method of installing a wellhead platform as claimed in claim 4, wherein the at least one means for supporting at least one conductor is lowered down from underneath the wellhead deck along the at least one conductor to a predetermined level or elevated from above the sub-sea conductor frame to a predetermined level.

8. A method of installing a wellhead platform as claimed in claim 7, wherein the at least one means for supporting at least one conductor is lowered down by using a lowering means or elevated using an elevating means configured to predetermined lengths.

9. A method of installing a wellhead platform as claimed in claim 1, wherein the offshore unit is a self-elevating mobile platform or a submersible platform or a semi-submersible platform.

10. A method of installing a wellhead platform as claimed in claim 9, wherein the self-elevating mobile platform is: i) a platform that includes the hull and/or deck frame, the mat attached to the at least one connecting leg and the at least one connecting leg substantially vertically upstanding from the mat to the hull and /or deck frame; or ii) a platform that includes the hull and/or deck frame, the spud can attached to each of the at least one connecting leg and the at least one connecting leg substantially vertically upstanding from the each of the spud can to the hull and/or deck frame.

11. A method of installing a wellhead platform as claimed in claim 9, wherein the installing of the self-elevating mobile platform includes the steps of: i) lowering the mat attached to at least one connecting leg or the spud can attached to each of the at least one connecting leg to a sea bed; and ii) elevating the hull and/or deck frame to a predetermined height.

12. A method of installing a wellhead platform as claimed in claim 9, wherein the installing of the a submersible platform includes the steps of ballasting the hull and/or lower hull until the lower hull reaches the sea bed and a predetermined soil bearing resistance is achieved.

13. A method of installing a wellhead platform as claimed in claim 9, wherein the installing of the semi-submersible platform includes the steps of i) securing the platform to the sea bed; and ii) lowering the sub-sea conductor frame to the sea bed.

14. A method of installing a wellhead platform as claimed in claim 1, wherein the installing of the at least one conductor is done by using a platform crane.

15. A method of installing a wellhead platform as claimed in claim 10, wherein the self-elevating mobile platform in (i) includes at least one conduit in the at least one connecting leg for transporting fluids.

16. A method of demobilizing a self-elevating mobile platform which has been used to install a wellhead platform that includes a wellhead deck, sub-sea conductor frame and at least one conductor using an offshore unit wherein the self-elevating mobile platform includes:

a hull and/or deck frame; and a mat attached to at least one connecting leg or a spud can attached to each of at least one connecting leg or to a hull, wherein the method includes the steps of:

i) hooking-up a mooring system (1) to the mat attached to the at least one connecting leg where the self-elevating mobile platform includes the mat or (2) to the at least one connecting leg where the self-elevating mobile platform includes the spud can attached to each of the at least one connecting leg or to the hull or (3) to a transportation means where the deck frame is used without a hull;

ii) activating lowering means to lower the hull down to water level or the deck frame down onto the transportation means where the deck frame is used without a hull;

iii) activating heightening means to jack up the mat attached to the at least one connecting leg or the spud can attached to each of at least one connecting leg off a sea bed;

iv) activating of maneuvering means to space apart the self-elevating mobile platform from the wellhead platform;

v) activating the heightening means to jack up the mat attached to the at least one connecting leg or the spud can attached to each of the at least one connecting leg until contact with the hull or deck frame;

vi) de-ballasting the mat attached to at least one connecting leg or hull where hull is used without a mat or transportation means where deck frame is used without a hull or mat to achieve tow conditions; and vii) disconnecting the mooring system from the mat attached to at least one connecting leg or the at least one connecting leg which is attached to the spud can and from the hull or transportation means where the deck frame is used without a hull.

17. A method of demobilizing a self-elevating mobile platform as claimed in claim 16, wherein the mooring system includes at least four sets of bridles pre-laid prior to hooking-up to the self-elevating mobile platform.

18. A method of demobilizing a self-elevating mobile platform as claimed in claim 17, wherein the at least four sets of bridles are made up of chains, tri-plates, shackles and/or wire ropes.

19. A method of demobilizing a self-elevating mobile platform as claimed in claim 18, wherein each of the at least four bridles are attached to a securing means to the sea bed.

20. A method of demobilizing a self-elevating mobile platform as claimed as in claim 16, wherein the activating of maneuvering means to space apart the self-elevating mobile platform from the wellhead platform in step (iv) allows detachment of the wellhead platform from the self-elevating mobile platform.

21. A method of demobilizing a self-elevating mobile platform as claimed in claim 20, wherein the detached wellhead platform is left behind for further drilling, well intervention, production and/or abandonment.

* * * * *